US008380104B2

(12) United States Patent
Matsumoto et al.

(10) Patent No.: US 8,380,104 B2
(45) Date of Patent: Feb. 19, 2013

(54) REPLACEMENT UNIT AND IMAGE FORMING DEVICE

(75) Inventors: Takuji Matsumoto, Saitama (JP); Toshio Takiguchi, Saitama (JP); Shinichi Ohba, Saitama (JP); Takayuki Yazawa, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 376 days.

(21) Appl. No.: 12/723,018

(22) Filed: Mar. 12, 2010

(65) Prior Publication Data

US 2010/0239310 A1 Sep. 23, 2010

(30) Foreign Application Priority Data

Mar. 19, 2009 (JP) ..... 2009-068852
Oct. 2, 2009 (JP) ..... 2009-230588

(51) Int. Cl.
*G03G 21/16* (2006.01)

(52) U.S. Cl. ..... 399/111

(58) Field of Classification Search ..... 399/110, 399/111, 113
See application file for complete search history.

(56) References Cited

U.S. PATENT DOCUMENTS

| | | | | |
|---|---|---|---|---|
| 5,933,691 | A | 8/1999 | Johroku | |
| 7,184,686 | B2 * | 2/2007 | Kanno et al. | 399/111 |
| 7,212,767 | B2 * | 5/2007 | Hosokawa et al. | 399/111 |
| 2004/0096239 | A1 | 5/2004 | Hosokawa et al. | |
| 2004/0170447 | A1 | 9/2004 | Arai et al. | |
| 2007/0166074 | A1 | 7/2007 | Hosokawa et al. | |
| 2007/0237551 | A1 | 10/2007 | Kawai | |
| 2007/0248384 | A1 | 10/2007 | Kawai | |
| 2008/0152386 | A1 | 6/2008 | Sakaguchi et al. | |
| 2008/0279586 | A1 | 11/2008 | Tatsumi et al. | |
| 2009/0028601 | A1 | 1/2009 | Mizuno et al. | |

FOREIGN PATENT DOCUMENTS

| | | | |
|---|---|---|---|
| JP | 10-142915 | A | 5/1998 |
| JP | 11-078502 | A | 3/1999 |
| JP | 2001-337511 | A | 12/2001 |
| JP | 2003-114568 | A | 4/2003 |
| JP | 2003-216002 | A | 7/2003 |
| JP | 2004-170821 | A | 6/2004 |
| JP | 2004-280070 | A | 10/2004 |
| JP | 2004-294604 | A | 10/2004 |
| JP | 2006-078923 | A | 3/2006 |
| JP | 2006-154410 | A | 6/2006 |
| JP | 2007-279532 | A | 10/2007 |
| JP | 2007-293035 | A | 11/2007 |
| JP | 2008-139818 | A | 6/2008 |
| JP | 2008-158381 | A | 7/2008 |
| JP | 2008-310292 | A | 12/2008 |

OTHER PUBLICATIONS

Notice of Reasons for Rejection mailed Feb. 1, 2011 in corresponding Japanese patent application No. 2009-068852.

* cited by examiner

*Primary Examiner* — Sandra Brase
(74) *Attorney, Agent, or Firm* — Sughrue Mion, PLLC

(57) ABSTRACT

A replacement unit includes a bottom member and a guide groove. The bottom member is supported at one of plural support members. The guide groove provided at the bottom member, is guided by plural protrusions provided at the support member and disposed in a row, and extends in an installation direction along which the replacement unit is installed in a device body from sideward of the device body.

20 Claims, 23 Drawing Sheets

REPLACEMENT UNIT AND IMAGE FORMING DEVICE

CROSS-REFERENCE TO RELATED APPLICATIONS

This application is based on and claims priority under 35 USC 119 from Japanese Patent Application Nos. 2009-068852 and 2009-230588, filed on Mar. 19, 2009 and Oct. 2, 2009.

BACKGROUND

1. Technical Field

The present invention relates to a replacement unit and an image forming device.

2. Related Art

Related art image forming devices include, for example, plural process cartridges (replacement units) that are detachably retained in an image forming device are described.

Each process cartridge includes a photoreceptor and at least one electrophotographic processing means that acts on the photoreceptor.

The plural process cartridges are arrayed in a horizontal direction. Circular rod-form pin members that extend in a mounting direction are formed at side portions of the process cartridges. When a process cartridge is being inserted into the body of the device, a pin member formed at the process cartridge that is being inserted slides into a positioning hole provided at a process cartridge that is already mounted in the device body.

SUMMARY

An aspect of the present invention is a replacement unit including: a bottom member supported at one of plural support members; and a guide groove provided at the bottom member, is guided by plural protrusions provided at the support member and disposed in a row, and that extends in an installation direction along which the replacement unit is installed in a device body from sideward of the device body.

BRIEF DESCRIPTION OF THE DRAWINGS

Exemplary embodiments of the present invention will be described in detail based on the following figures, wherein.

DETAILED DESCRIPTION

First Exemplary Embodiment

Overall Structure

Figure 8:
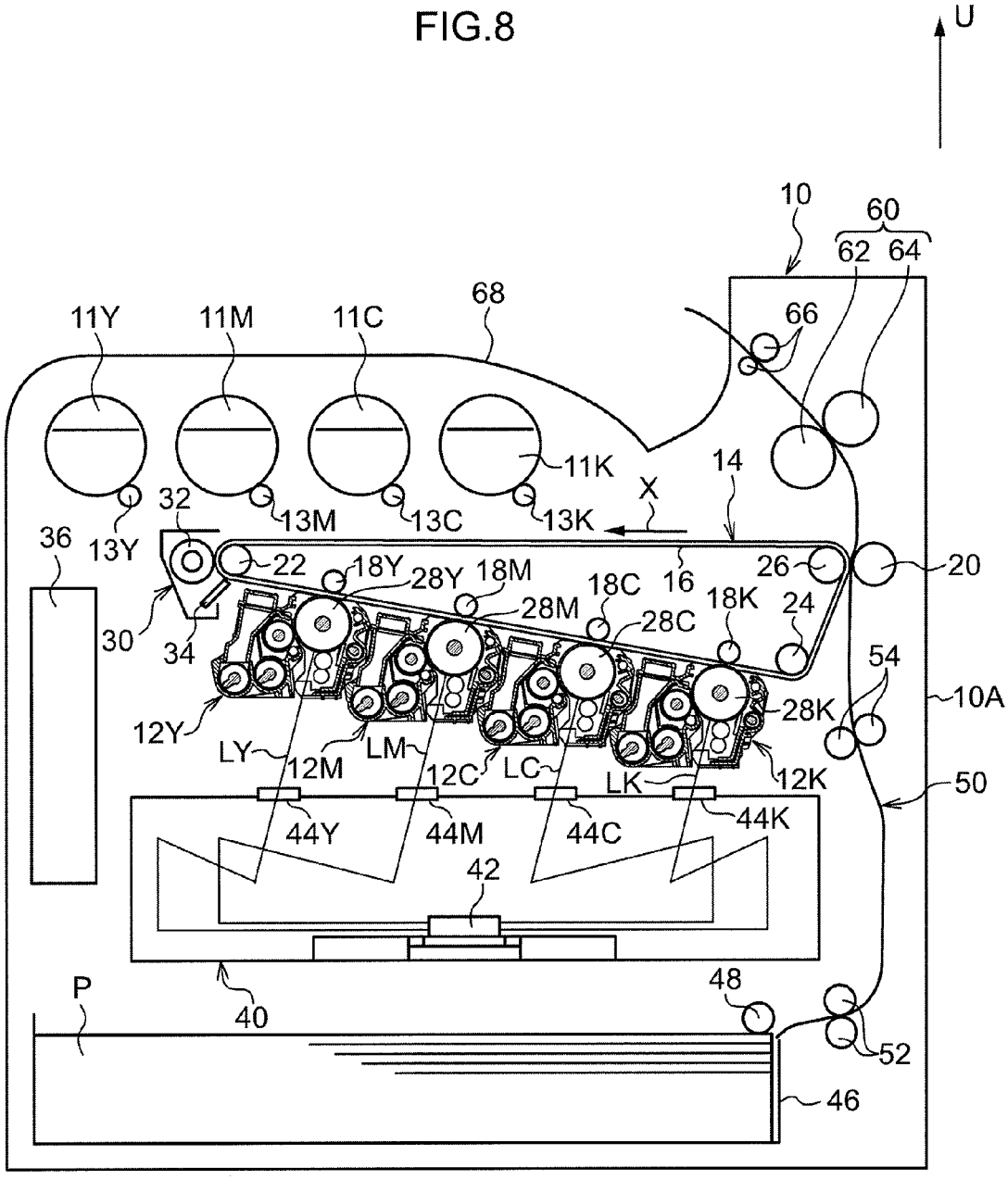
FIG. 8 is a schematic structural diagram illustrating an image forming device in which the image formation unit is employed.

As illustrated in FIG. 8, an image processing device (not shown) is provided inside an image forming device 10. The image processing device applies image processing to image data that is sent thereto from a personal computer or suchlike.

Toner cartridges 11Y, 11M, 11C and 11K that accommodate toners of the colors yellow (Y), magenta (M), cyan (C) and black (K) are replaceably provided at the top of the interior of the image forming device 10. In the subsequent descriptions, Y, M, C and K are appended to reference numerals to distinguish between members corresponding to the colors yellow, magenta, cyan and black.

One ends of toner supply paths 13Y, 13M, 13C and 13K are connected to the toner cartridges 11Y, 11M, 11C and 11K, respectively.

Figure 7:
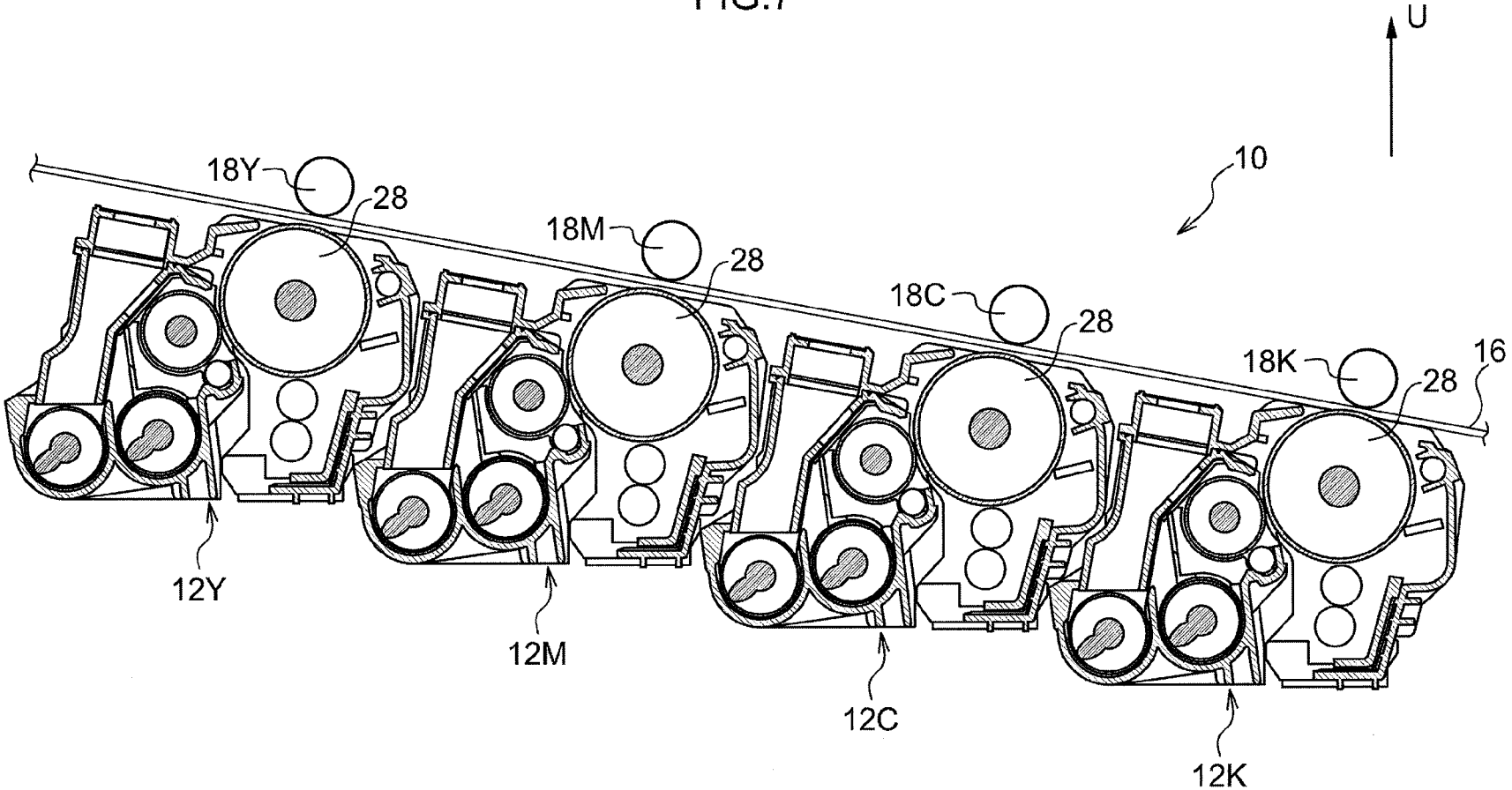
FIG. 7 is a sectional view illustrating the image formation units.

Image formation units 12 (12Y, 12M, 12C and 12K), which serve as four replacement units corresponding to developers of Y, M, C and K, are disposed at the middle of the interior of the image forming device 10 in a state in which portions thereof overlap with one another diagonally downward to the right in a front view (see FIG. 7).

The developers are agents in which magnetic carriers are mixed with non-magnetic types of toner. The other ends of the toner supply paths 13Y, 13M, 13C and 13K are connected to the four image formation units 12Y, 12M, 12C and 12K, respectively, and supply toners of the respective colors to the image formation units 12.

A transfer section 14 is provided above the image formation units 12Y, 12M, 12C and 12K. The transfer section 14 includes an intermediate transfer belt 16, first transfer rollers 18Y, 18M, 18C and 18K and a second transfer roller 20. The intermediate transfer belt 16 is an example of an intermediate transfer body. The first transfer rollers 18Y, 18M, 18C and 18K are four first transfer members that multiplexingly transfer toner images from the image formation units 12Y, 12M, 12C and 12K onto the intermediate transfer belt 16. The second transfer roller 20 transfers the superposed toner images on the intermediate transfer belt 16 onto a sheet member P that serves as a recording medium.

The intermediate transfer belt 16 is wound round a driving roller 22 that is driven by an unillustrated motor, a tension roller 24 that adjusts tension of the intermediate transfer belt 16, and a backup roller 26 that is disposed to oppose the second transfer roller 20. The intermediate transfer belt 16 is driven to circulate in the direction of arrow X in FIG. 8 (the anticlockwise direction) by the driving roller 22.

The intermediate transfer belt 16 is formed using a belt in which a suitable amount of an antistatic agent such as carbon black or the like is contained in a resin, such as a polyimide, polycarbonate, polyester, polypropylene or the like, or one of various rubbers, such that the volume resistivity is $10^6$ to $10^{14}$ Ω·cm.

The first transfer rollers 18 (18Y, 18M, 18C and 18K) are disposed to oppose photoreceptors 28 (28Y, 28M, 28C and 28K), which serve as image-holding members that are provided at the image formation units 12Y, 12M, 12C and 12K, respectively, to sandwich the intermediate transfer belt 16 between the first transfer rollers 18 and the photoreceptors 28. At the first transfer rollers 18Y, 18M, 18C and 18K, transfer bias voltages of the opposite polarity to a polarity of the toners are applied by a power supply unit (not shown). At the second transfer roller 20, a transfer bias voltage of the opposite polarity to the toner polarity is applied by the power supply unit.

A cleaning device 30 is provided at the outer face of the intermediate transfer belt 16 at a position at which the driving roller 22 is provided. The cleaning device 30 is provided with a cleaning brush 32 and a cleaning blade 34, and removes residual toner, paper dust and the like on the intermediate transfer belt 16 with the cleaning brush 32 and the cleaning blade 34.

A control unit 36, which controls driving of the various sections of the image forming device 10, is provided inside the image forming device 10. An exposure unit 40 is provided below the image formation unit 12. The exposure unit 40 illuminates exposure lights L corresponding to the respective colors (LY, LM, LC and LK) at surfaces of the photoreceptors 28, which have been electrostatically charged, and forms electrostatic latent images.

An f-θ lens (not shown) and a polygon mirror 42 are provided inside the exposure unit 40, for scanning the exposure lights L in a main scanning direction. Glass windows 44Y, 44M, 44C and 44K are also provided, for emitting the four exposure lights LY, LM, LC and LK towards the photoreceptors 28 of the image formation units 12Y, 12M, 12C and 12K.

A paper supply cassette 46 in which sheet members P are accommodated is disposed below the exposure unit 40. A paper supply path 50, along which the sheet members P are conveyed, is provided from an end of the paper supply cassette 46 to upward in the vertical direction.

A paper supply roller 48, a roller pair 52 and rollers 54 are provided on the paper supply path 50. The paper supply roller 48 feeds out a sheet member P from the paper supply cassette 46. The roller pair 52 is for paper separation and conveyance, supplying the sheet members P one sheet at a time. The rollers 54 position leading ends of the paper to match conveyance timings of the sheet members P with movement timings of images on the intermediate transfer belt 16.

A fixing device 60 is provided above the second transfer roller 20. The fixing device 60 is provided with a heating roller 62, which is heated, and a pressure roller 64, which is pressed against the heating roller 62. Toner images of the respective colors that have been transferred by the second transfer roller 20 to a sheet member P are fixed by heat and pressure at a portion of abutting between the heating roller 62 and the pressure roller 64. This sheet member P is ejected by ejection rollers 66, which are provided at the downstream side in the conveyance direction of the sheet member P, to an ejection section 68 provided at a top portion of the image forming device 10. At the surface of the intermediate transfer belt 16 at which the second transfer process of the toner images has been completed, residual toner, paper dust and the like are removed by the cleaning device 30.

Next, the image formation units 12 are described.

Here, the image formation unit 12M will be described as an example. The image formation units 12Y, 12C and 12K corresponding to the other colors have structures the same as the image formation unit 12M, so descriptions thereof are not given. The structural members of the image formation unit 12M are indicated with M being omitted from the reference numerals.

The image formation unit 12 is attachable/detachable with respect to a device body (casing) 10A from sideward of the device body 10A, and may be replaced with a new one of the image formation unit 12. In the present exemplary embodiment, as an example, the image formation unit 12 is replaceable from a front face direction of the image forming device 10 in which the image formation unit 12 is disposed. Herein, the meaning of the term sideward includes directions orthogonal with respect to upward and downward of the image forming device 10 in which the image formation unit 12 is disposed, and is not to be particularly limited by the front face direction of the image forming device 10 in which the image formation unit 12 is disposed.

Figure 6:
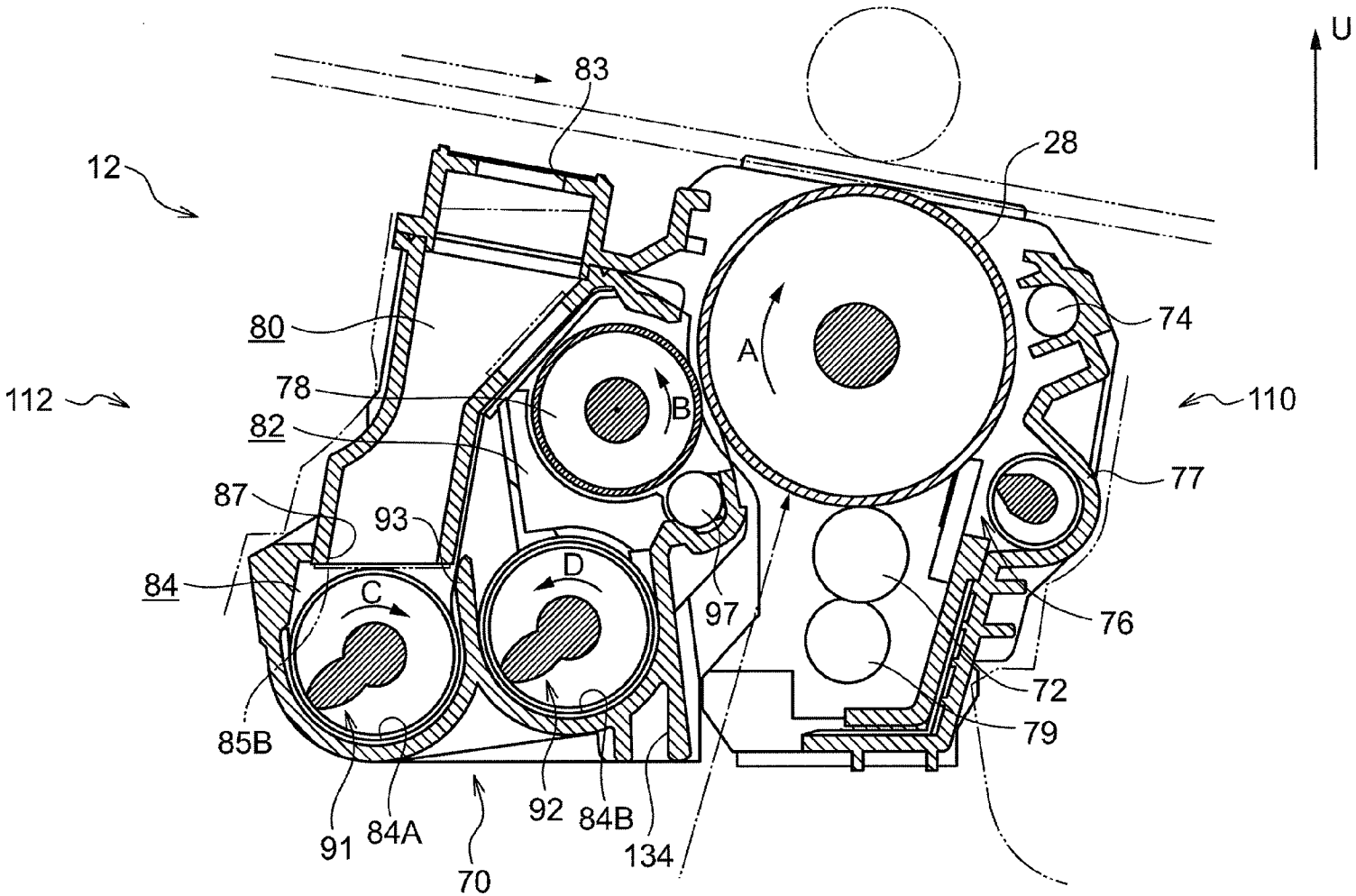
FIG. 6 is a sectional view illustrating the image formation unit.

As illustrated in FIG. 6, a charging roller 72, a developing section 70, an erasure lamp 74 and a cleaning blade 76 are provided in the image formation unit 12. The charging roller 72 serves as an electrostatic charging member that touches against the surface of the photoreceptor 28 and uniformly charges the photoreceptor 28. The developing section 70 develops an electrostatic latent image that has been formed on the photoreceptor 28 by the exposure light L with the developer (toner) of the respective color. The erasure lamp 74 is an example of a de-electrifying device that illuminates light onto the surface of the photoreceptor 28 subsequent to transfer and removes charges. The cleaning blade 76 serves as an image-holding member cleaning member that cleans the surface of the photoreceptor 28 subsequent to charge removal.

The charging roller 72, the developing section 70, the erasure lamp 74 and the cleaning blade 76 are arranged, opposing the surface of the photoreceptor 28, in this order from an upstream side to a downstream side of a direction of rotation of the photoreceptor 28.

A cleaning roller 79 is rotatably provided at the opposite side of the outer peripheral face of the charging roller 72 from the side thereof at which the photoreceptor 28 is disposed. The cleaning roller 79 serves as a charging cleaning member that removes toner and the like adhering to the surface of the charging roller 72.

The developing section 70 includes a developer accommodation chamber 80, a developing chamber 82, and an agitation/conveyance chamber 84. The developer accommodation chamber 80 is disposed at a left end of the image formation unit 12M and is charged with developer G. The developing chamber 82 is disposed between the developer accommodation chamber 80 and the photoreceptor 28. The agitation/conveyance chamber 84 is provided below the developer accommodation chamber 80 and the developing chamber 82, agitates (mixes) the developer G that is supplied thereto from the developer accommodation chamber 80 and conveys the same to the developing chamber 82.

A rectangular first aperture 83 is formed at a top portion of the developer accommodation chamber 80. The developer G flows in through the first aperture 83 from the outside to be charged into the developer accommodation chamber 80.

A rectangular second aperture 87 is formed at a bottom portion of the developer accommodation chamber 80. The developer accommodation chamber 80 and the agitation/conveyance chamber 84 are in fluid communication through the second aperture 87. The developer G that is charged into the developer accommodation chamber 80 and flows down inside the developer accommodation chamber 80 flows through the second aperture 87 into the agitation/conveyance chamber 84.

The second aperture 87 is sealed in advance by a sealing member 85B. Before installation of the image formation unit 12 into the image forming device 10, the second aperture 87 is opened by the sealing member 85B being pulled off through one of the side faces of the image formation unit 12.

The agitation/conveyance chamber 84 is divided by a dividing wall 93, and a two-stage agitation path, of a first agitation path 84A and a second agitation path 84B, is provided. Communication apertures (not shown) are formed at positions at two ends of the dividing wall 93, and the first agitation path 84A and second agitation path 84B are in fluid communication through the communication apertures.

An upper face of the second agitation path 84B is open, and is in fluid communication with the developing chamber 82, upward of which a developing roller 78 is disposed.

A first agitation/conveyance member 91 is disposed in the first agitation path 84A. Similarly, a second agitation/conveyance member 92 is disposed in the second agitation path 84B. The developer G in the agitation/conveyance chamber 84 is mixed with supplied toner by the first agitation/conveyance member 91 being turned in the direction of arrow C and the second agitation/conveyance member 92 being turned in the direction of arrow D, is conveyed while being agitated and mixed both in the first agitation path 84A and in the second agitation path 84B, and is circulated between the first agitation path 84A and the second agitation path 84B.

The developing roller 78 is provided in the developing chamber 82. The developing roller 78 rotates in the direction of arrow B (the anticlockwise direction) about a length direction of the photoreceptor 28, moves the toner in the developer G toward a latent image on the photoreceptor 28 at a time of development, and forms a toner image. In the developing chamber 82, a thin layer-forming roller 97 is also provided. The thin layer-forming roller 97 serves as a layer regulation member.

A shutter member 86 (see FIG. 3) and a shutter member 90 (see FIG. 2) are provided in the image formation unit 12. The shutter member 86 closes the first aperture 83, at which toner is taken in from the aforementioned toner supply path 13 (see FIG. 8). The shutter member 90 closes off a discharge aperture 88 through which discharge toner is discharged. When the image formation unit 12 is installed into the device body 10A, the shutter member 86 and the shutter member 90 meet unillustrated shutter-opening members that are provided at the device body, and open up the first aperture 83 and the discharge aperture 88.

Next, an image forming process of the image forming device 10 is described.

As illustrated in FIG. 8, image data to which image processing has been applied by the image processing device (not shown) is then converted to color gradation data of the four colors yellow (Y), magenta (M), cyan (C) and black (K), and is sequentially outputted to the exposure unit 40. In the exposure unit 40, the exposure lights L are emitted in accordance with the color gradation data of the respective colors, scanning exposure is performed onto the photoreceptors 28, and electrostatic latent images are formed.

The electrostatic latent images formed on the photoreceptors 28 are manifested and developed as toner images of the respective colors by the developing sections 70. The toner images of the respective colors that are sequentially formed on the photoreceptors 28 of the image formation units 12Y, 12M, 12C and 12K are then sequentially overlapped and transferred onto the intermediate transfer belt 16 by the four first transfer rollers 18Y, 18M, 18C and 18K.

The toner images of the respective colors that have been overlapped and transferred onto the intermediate transfer belt 16 are secondly transferred by the second transfer roller 20 onto the sheet member P that has been conveyed thereto. The toner images of the respective colors on the sheet member P are fixed by the fixing device 60, and after fixing, the sheet member P is ejected to the ejection section 68.

At the surface of the photoreceptor 28 after the toner image transfer process has ended, residual toner, paper dust and the like are removed by the cleaning blade 76. Furthermore, residual toner, paper dust and the like on the intermediate transfer belt 16 are removed by the cleaning device 30.

Structure of Principal Elements

Figure 5A:
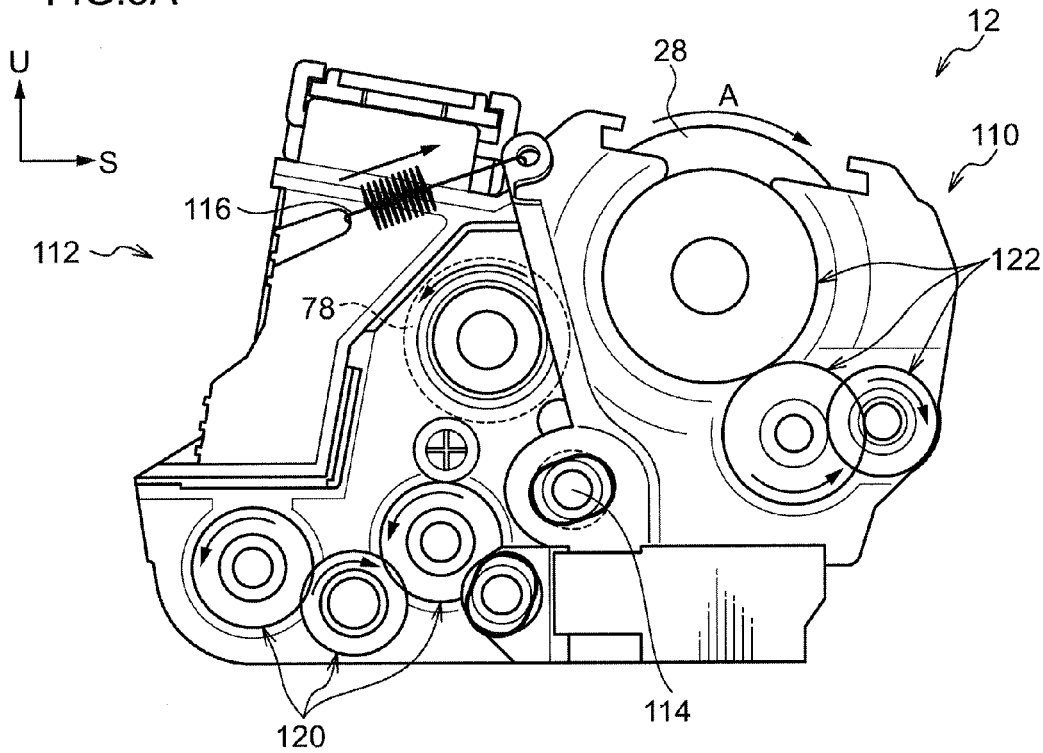
FIG. 5A and FIG. 5B are side views viewed from one end and another end of the image formation unit.
Figure 5B:
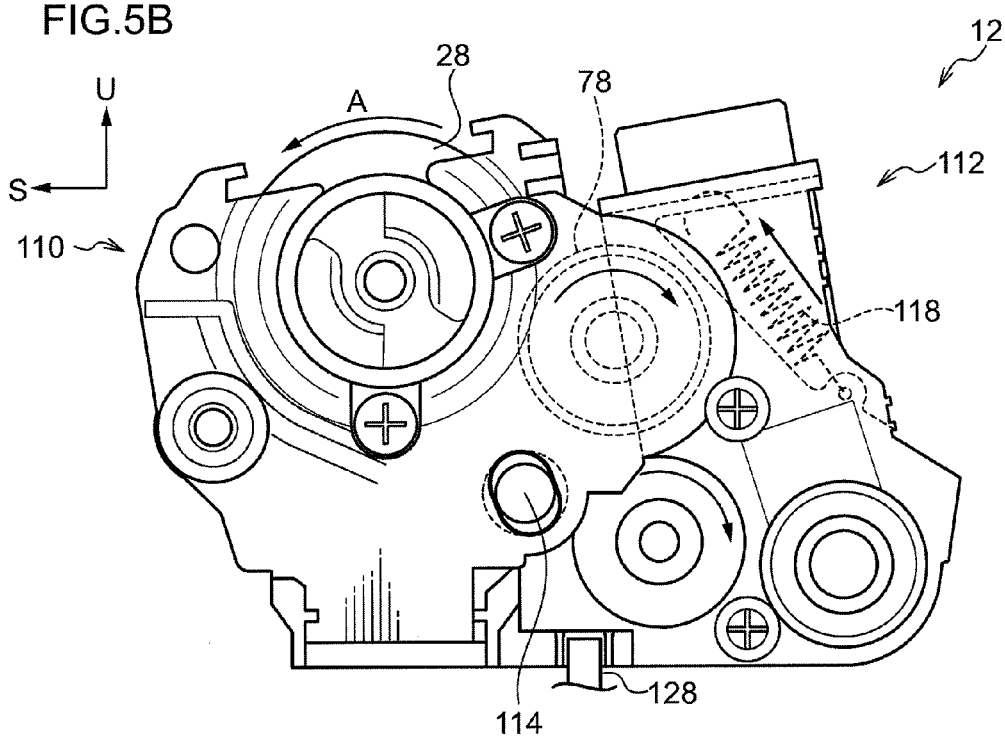

As illustrated in FIG. 5A and FIG. 5B, the image formation unit 12 includes a photoreceptor unit 110 and a developing unit 112. The photoreceptor unit 110 is provided with the photoreceptor 28, which is driven to rotate in the direction of arrow A (the anti-clockwise direction). The developing unit 112 is provided with the developing roller 78 that supplies toner to the electrostatic latent image formed on the surface of the photoreceptor 28. The photoreceptor unit 110 and the developing unit 112 are supported to be relatively rotatable by an axle member 114. Structurally, the developing unit 112 is heavier than the photoreceptor unit 110.

As illustrated in FIG. 5A, when the image formation unit 12 is viewed from one end thereof, a coil spring 116 that serves as an urging member is provided so as to extend between the photoreceptor unit 110 and the developing unit 112. Respective ends of the coil spring 116 are fixed to the photoreceptor unit 110 and the developing unit 112. A gear member 120, which transmits rotary force to the first agitation/conveyance member 91 and second agitation/conveyance member 92, is provided at the developing unit 112, and a gear member 122, which transmits rotary force to the photoreceptor 28, is provided at the photoreceptor unit 110.

On the other hand, when the image formation unit 12 is viewed from the other end thereof as illustrated in FIG. 5B, a coil spring 118 that serves as an urging member is provided so as to extend between the photoreceptor unit 110 and the developing unit 112. Respective ends of the coil spring 118 are fixed to the photoreceptor unit 110 and the developing unit 112.

With this structure, a predetermined positional relationship of the developing unit 112 and the photoreceptor unit 110 is preserved by the urging force of the coil springs 116 and 118.

Figure 3:
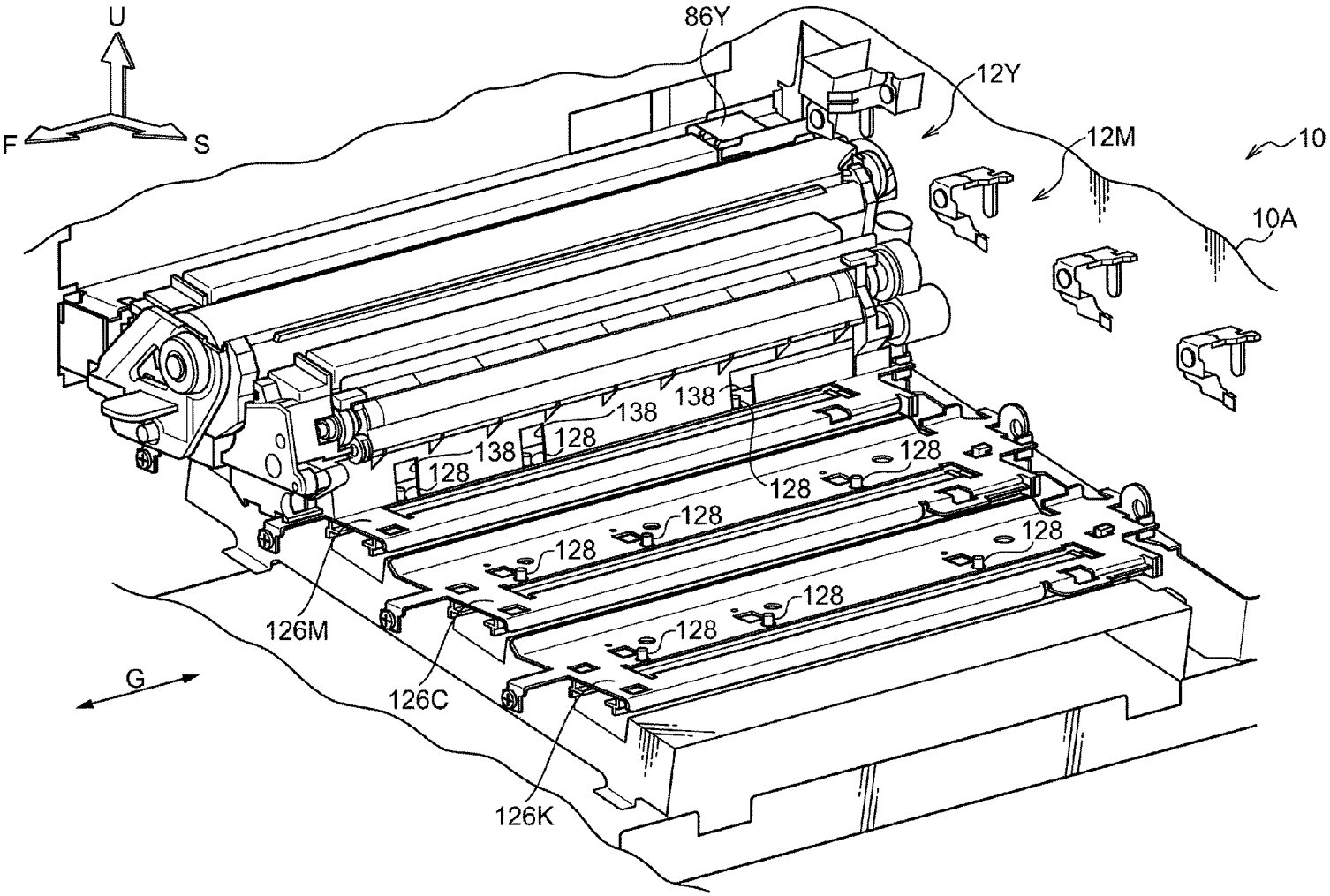
FIG. 3 is a perspective view illustrating the image formation unit, and support plates, guide pins and the like at which image formation units are supported.

As illustrated in FIG. 3, four support plates 126 are provided inside the image forming device 10. The respective image formation units 12 are supported at the support plates 126. Circular rod-form guide pins 128, which are formed of a resin material, are provided so as to protrude from circular holes formed in the support plates 126 and extend upward.

More specifically, plural (three in the present exemplary embodiment) guide pins 128 are provided along an installation direction of each image formation unit 12 (direction G shown in the drawing). A spacing between the first guide pin 128 from an outer end (near side) of the installation direction of the image formation unit 12 and the second guide pin 128 is set to be narrower than a spacing between the second guide pin 128 and the third guide pin 128.

FIG. 3 is drawn with the photoreceptor unit 110 of the image formation unit 12M omitted, in order to facilitate understanding of the structure of the guide pins 128 protruding from the support plate 126M.

Figure 1:
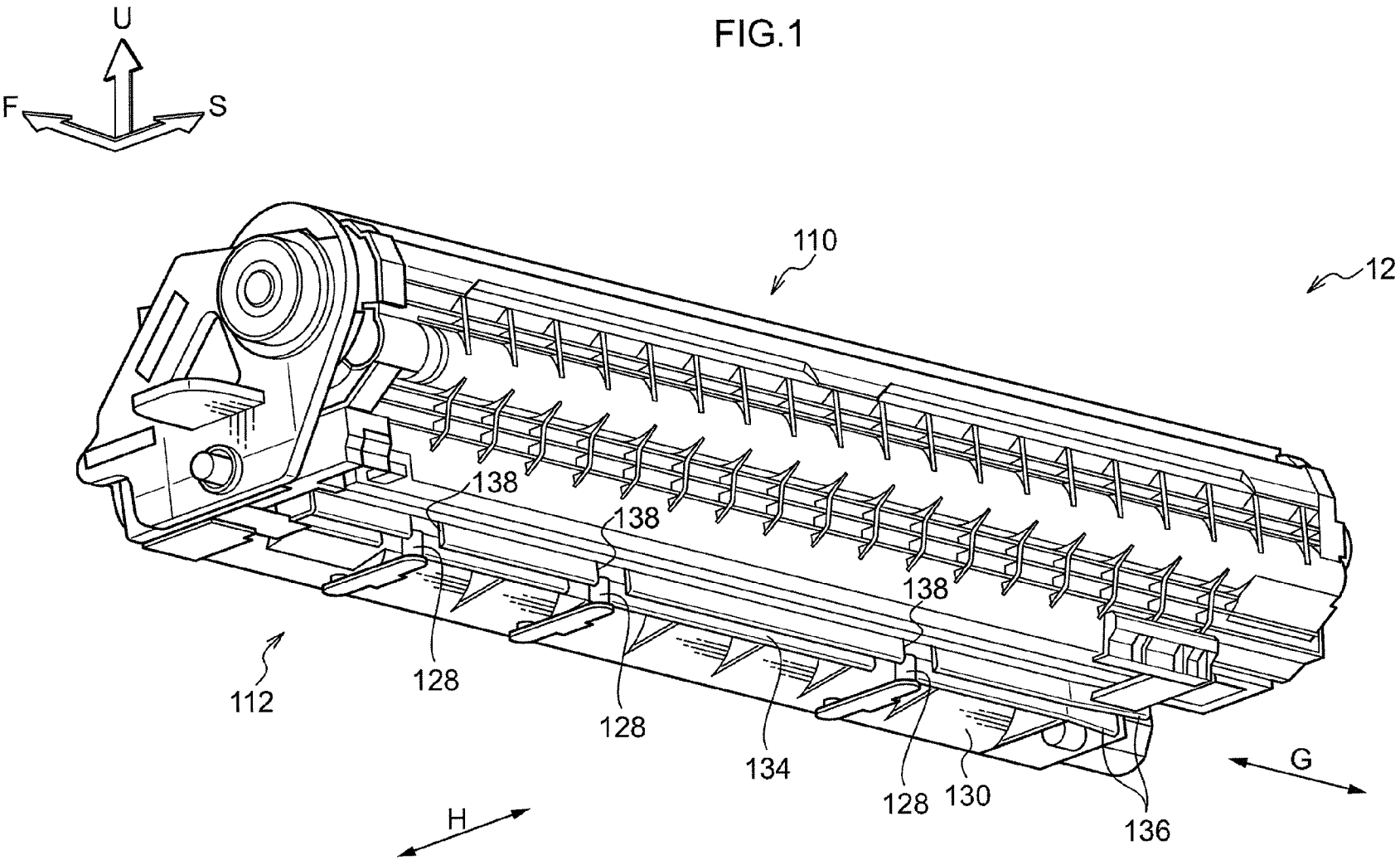
FIG. 1 is a perspective view illustrating an image formation unit relating to an exemplary embodiment.
Figure 2:
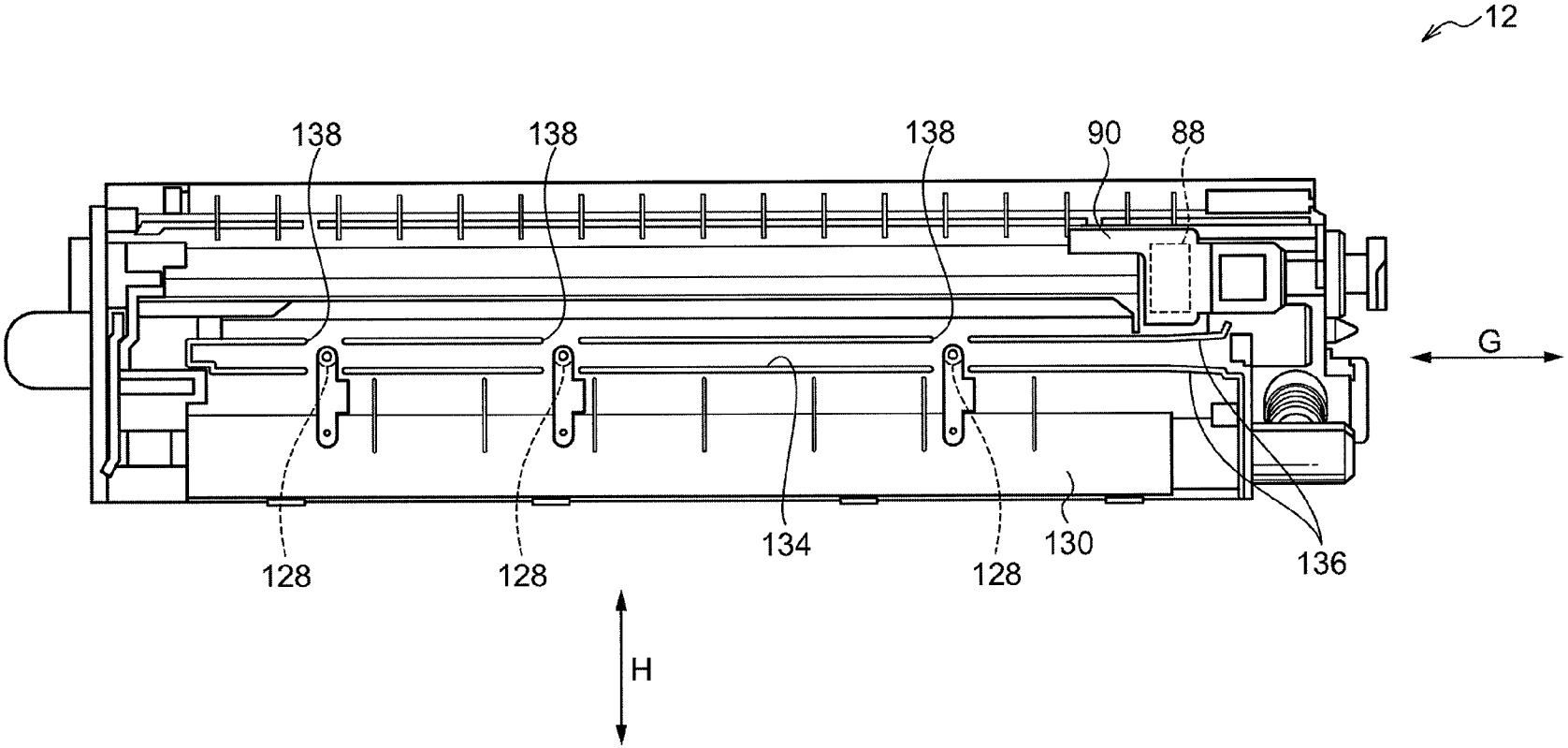
FIG. 2 is a bottom view illustrating the image formation unit.

Meanwhile, as illustrated in FIG. 1 and FIG. 2, a recessed guide groove 134 is provided in a bottom member 130 that structures a bottom portion of the developing unit 112. The guide groove 134 extends in the attachment/detachment direction of the image formation unit 12 (direction G shown in the drawings). The bottom member 130 could as well be formed integrally with a housing of the developing unit 112.

More specifically, when the image formation unit 12 is being installed, the guide groove 134 is guided by the guide pins 128 provided in the device body 10A, such that the image formation unit 12 is attached/detached from the image forming device 10 in the direction of arrow G.

A tapering portion 136 is provided at the guide groove 134. The tapering portion 136 serves as a guiding-in portion that guides in the guide pins 128 when the image formation unit 12 is installed in the device body 10A.

Notches 138 are also provided at the guide groove 134. The notches 138 serve as allowance portions that, in the state in which the image formation unit 12 has been installed in the device body 10A, allow movement of the developing unit 112 relative to the guide pins 128 at a time when the developing unit 112 is pulled toward the photoreceptor unit 110 by a reaction force when the gear member 120, which turns the developing roller 78, first agitation/conveyance member 91 and second agitation/conveyance member 92 disposed in the developing unit 112 (see FIG. 6), or the like is driven.

That is, when the developing unit 112 is pulled toward the photoreceptor unit 110 and the developing unit 112 acts so as to move in a direction orthogonal to the installation direction of the image formation unit 12 (direction H shown in the drawings), the developing unit 112 moves without the guide groove 134 abutting against the guide pins 128.

Positions of the shutter member 90 and shutter member 86 (see FIG. 3) are set such that, after all the guide pins 128 have passed through the tapering portion 136 when the image formation unit 12 is being installed in the device body 10A, the shutter member 90 and shutter member 86 abut against the shutter-opening members (not shown) and are opened.

FIG. 1 and FIG. 2 are drawn with members such as the support plates 126 and the like omitted, such that positional relationships of the guide groove 134 of the image formation unit 12 installed in the device body 10A with the guide pins 128 may be easily understood.

Operation of the First Exemplary Embodiment

Figure 4A:
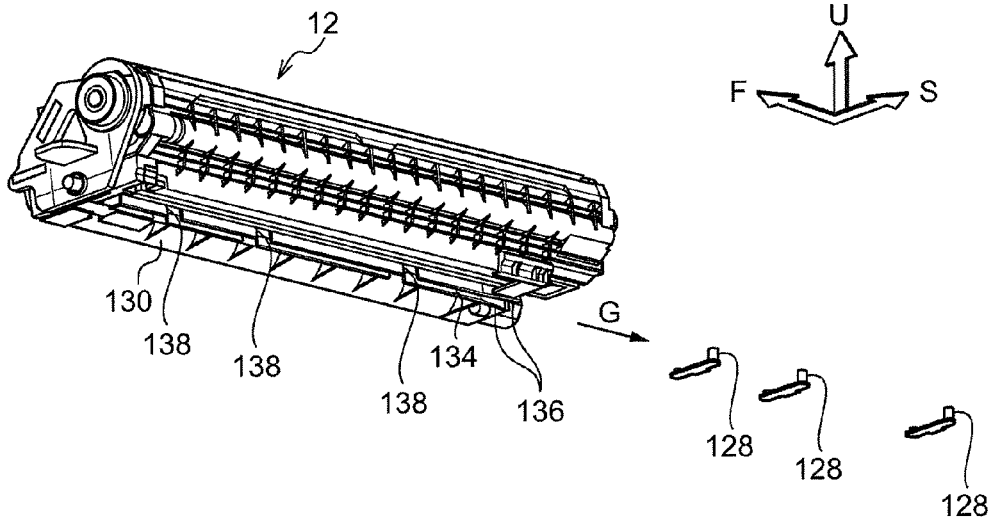
FIG. 4A to FIG. 4C are perspective views illustrating states of installation of the image formation unit.
Figure 4B:
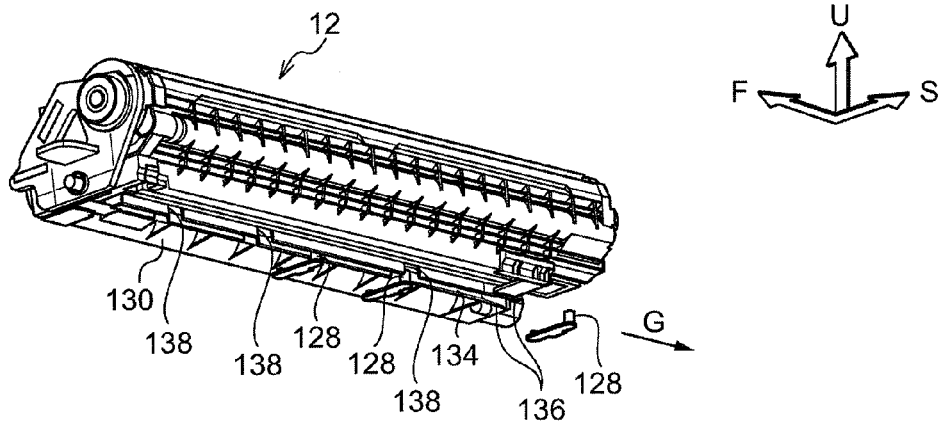
Figure 4C:
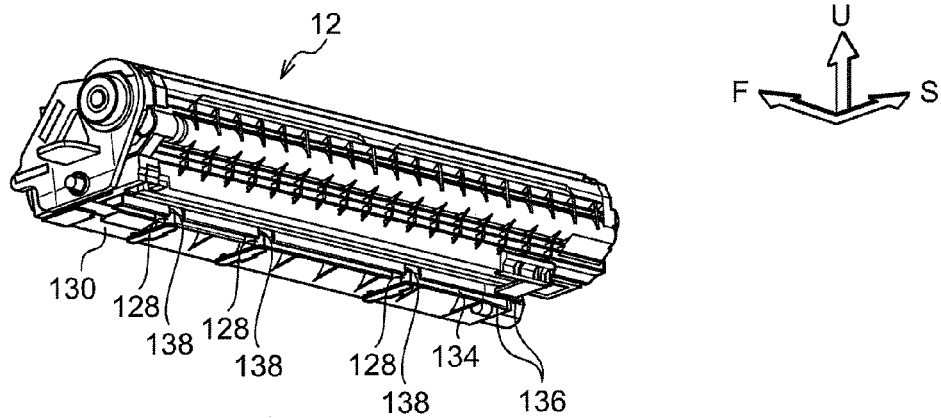

FIG. 4A to FIG. 4C show positional relationships between the image formation unit 12 and the guide pins 128 when the image formation unit 12 is being installed in the device body 10A (see FIG. 3) in a time series. FIG. 4A to FIG. 4C are drawn with members such as the support plate 126 and the like omitted such that the positional relationship of the guide pins 128 with the guide groove 134 of the image formation unit 12 may be easily understood.

As illustrated in FIG. 4A, when the image formation unit 12 is mounted to the device body 10A, the image formation unit 12 is moved in the direction of the arrow G. Firstly, the first guide pin 128 from the outer end of the installation direction of the image formation unit 12 (at the left side in the drawings) is guided into the guide groove 134 through the tapering portion 136 provided at the end of the guide groove 134.

As illustrated in FIG. 4B, after the first guide pin 128, the second guide pin 128 (toward the middle of the drawings) and the third guide pin 128 (at the right side in the drawings) are similarly guided into the guide groove 134.

Now, as mentioned above, the spacing between the first guide pin 128 and the second guide pin 128 is set to be narrower than the spacing between the second guide pin 128 and the third guide pin 128. That is, a structure is formed in which the first and second guide pins 128 are guided into the guide groove 134 with a quick timing.

Furthermore, because the spacings of the neighboring guide pins 128 are different, the guide pins 128 will not disengage from the guide groove 134 through the notches 138 during the operation of installation of the image formation unit 12.

As illustrated in FIG. 1 and FIG. 4C, when the image formation unit 12 has been installed in the device body 10A, the guide pins 128 oppose the notches 138, and the developing unit 112 is movable in the direction orthogonal to the installation direction (direction H in the drawings). That is, when the developing unit 112 is pulled toward the photoreceptor unit 110 by reaction force when the gear member 120 that turns the developing roller 78, first agitation/conveyance member 91 and second agitation/conveyance member 92 disposed in the developing unit 112 (see FIG. 6) is driven, the developing unit 112 moves in a direction orthogonal to the axial direction of the developing roller 78, and an axial separation between the developing roller 78 of the developing unit 112 and the photoreceptor 28 of the photoreceptor unit 110 is preserved.

Furthermore, when the image formation unit 12 is being installed in the device body 10A, the only means for guiding the image formation unit 12 is the guide pins 128 protruding from the support plate 126. That is, there is no need to provide guide means between neighboring image formation units 12.

Moreover, because the guide groove 134 is guided by the guide pins 128, tuning for correcting the guiding direction or the like is easier than in a case in which the guide groove 134 is guided by a rail-type protrusion portion that extends in the installation direction of the image formation unit 12.

Second Exemplary Embodiment

Herebelow, portions of the second exemplary embodiment that are common with the first exemplary embodiment are indicated with the same reference numbers and are not described; only portions that are different are described.

Figure 9A:
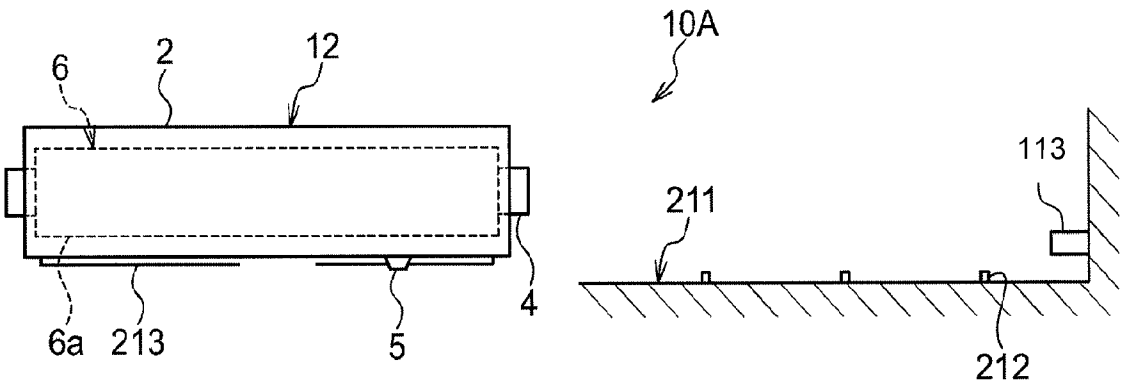
FIG. 9A is an explanatory diagram illustrating a state before an image formation unit is mounted at a holding portion of a casing of an image forming device relating to an exemplary embodiment.
Figure 9B:
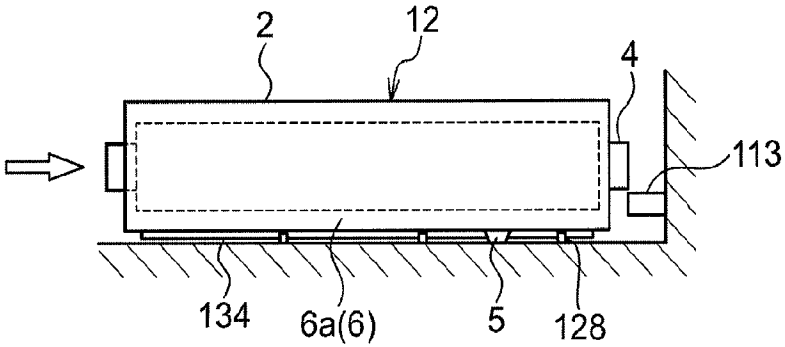
FIG. 9B is an explanatory diagram illustrating a state just before the image formation unit is mounted at a mounting position in the holding portion of the casing.

FIG. 9A and FIG. 9B are explanatory diagrams showing schematics of an image forming device of the second exemplary embodiment. FIG. 9A shows a state before the image formation unit is mounted in a holding portion of the device body 10A of the image forming device. FIG. 9B shows a state just before the image formation unit is mounted at a mounting position in the holding portion of the device body 10A.

In FIG. 9A, the image forming device is provided with a receiving portion 211, which is formed in the device body 10A, and the image formation unit 12, which is insertably/removably mounted on the receiving portion 211 and forms an image on a transfer medium.

The receiving portion 211 includes a guide portion 212, which is provided at a bottom face of the receiving portion 211 and guides the image formation unit 12 along an insertion/removal direction of the image formation unit 12, and a positioning portion 113, which is provided at a guiding direction inner end of the guide portion 212.

The image formation unit 12 includes a unit container 2, a guided portion 213, a positioned portion 4, and an insertion attitude adjustment portion 5. The unit container 2 accommodates structural elements that form images and is inserted into the receiving portion 211 of the device body 10A. The guided portion 213 is provided at a bottom portion of the unit container 2, and engages with and is guided by the guide portion 212 provided at a floor face of the receiving portion 211. The positioned portion 4 is provided protruding from one end of the unit container 2 at the insertion side of the insertion/removal direction, and is positioned at the positioning portion 113 when the image formation unit 12 has been inserted to the pre-specified mounting position in the receiving portion 211. The insertion attitude adjustment portion 5 is provided at the bottom portion of the unit container 2, touches against and moves along the floor face of the receiving portion 211 when the unit container 2 is inserted toward the mounting position of the receiving portion 211, and makes the positioned portion 4 insertable with respect to the positioning portion 113 in a state in which an attitude of the unit container 2 is adjusted such that the positioned portion 4 side of the unit container 2 is lifted up.

The receiving portion 211 of the device body 10A may have any suitable structure as long as it includes the floor face guide portion 212 and the positioning portion 113.

The floor face guide portion 212 may have any suitable structure as long as it is provided at a bottom face of the receiving portion 211 and guides the image formation unit 12.

In the present embodiment, the positioning portion 113 is located at the guide direction inner side of the floor face guide portion 212. However, an alternative system that performs positioning at the guide direction outer side of the floor face guide portion 212 when the image formation unit 12 is mounted at the mounting position of the receiving portion 211 may also be employed.

The image formation unit 12 requires the unit container 2 that accommodates at least structural elements 6 that form images (for example, if an electrophotography system is taken as an example, this includes an image-holding member 6*a* such as a photoreceptor or the like, a charging device that charges up the image-holding member 6*a*, a developing device that manifests an electrostatic latent image formed on the image-holding member 6*a* with toner, a recovery device that recovers waste toner and so forth). There may be one of this unit container 2 or it may be plurally divided (for example, into an image-holding member unit and a developing unit).

The guided portion 213 may have any suitable structure in accordance with the structure of the floor face guide portion 212 ((a) guide protrusion(s) or guide groove(s)) as long as the guided portion 213 keeps engagement with the floor face guide portion 212 of the receiving portion 211.

The positioned portion 4 may have any suitable structure as long as it is positioned by the positioning portion 113, but must be provided to at least protrude from the insertion side end of the unit container 2.

The insertion attitude adjustment portion 5 may be provided at a single location, at a different location from the guide mechanism formed by the floor face guide portion 212 and the guided portion 213, but there is no reason for it not to be plurally provided. The insertion attitude adjustment portion 5 may have any suitable structure as long as it adjusts so as to lift up the insertion attitude of the unit container 2, but a protrusion is typical.

An example of a typical structure of the image formation unit 12 is a structure in which the unit container 2 accommodates the rotatable image-holding member 6*a* that bears an image, which serves as the structural elements 6 that form images, and in which the positioned portion 4 is a support member (a bearing member) that rotatably supports the image-holding member 6*a*. In this case, the support member is combined with the positioned portion 4. Therefore, there is no need to provide the positioned portion 4 separately from the unit container 2.

With a view to more greatly adjusting the insertion attitude of the unit container 2, the protrusion that is a typical structure of the insertion attitude adjustment portion 5 may be provided at a bottom portion of the unit container 2 toward the positioned portion 4 (at the positioned portion 4 side relative to the middle of the image formation unit 12 along the insertion direction).

The unit container 2 may accommodate a recovery device into which residual matter may be recovered after image formation with the material that forms images, and may include an opening/closing cover that is provided at a discharge aperture in the bottom portion of the unit container 2, at which the residual material recovered by the recovery device may be discharged, and that covers the discharge aperture.

In this structure, the insertion attitude adjustment portion 5 may be provided at the bottom portion of the unit container 2 in the vicinity of the opening/closing cover, with a view to effectively preventing interference with the opening/closing cover when the image formation unit 12 is being mounted into the receiving portion 211 of the device body 10A.

With a view to excellently preserving positioning of the positioned portion 4 of the image formation unit 12 relative to the positioning portion 113, the receiving portion 211 may include a concavity (not shown) into which the insertion attitude adjustment portion 5 can be fit in, at a location that corresponds with the insertion attitude adjustment portion 5 in the state in which the image formation unit 12 is mounted at the mounting position of the receiving portion 211, and may set the attitude in which the image formation unit 12 is disposed to an attitude that is positioned at the positioning portion 113.

The term 'concavity' here may of course be a recess with a floor, but also includes penetrating holes.

When the concavity is provided in the receiving portion 211, one or both of the insertion attitude adjustment portion 5 and an edge portion of the concavity may include a guide incline portion (not shown), for removing the insertion attitude adjustment portion 5 from the state in which the insertion attitude adjustment portion 5 is fit into the concavity when the image formation unit 12 is being removed from the mounting position.

The guide incline portion guides the insertion attitude adjustment portion 5 so as to remove from the concavity when the image formation unit 12 is removed from the receiving portion 211.

The positioning portion 113 may include a lower side positioning member that catches on the positioned portion 4 of the image formation unit 12 from below in the positioned state, and an upper side positioning member that resiliently positions the positioned portion 4 from above.

For example, a substantially V-shaped positioning plate may be an example of the lower side positioning member and a spring member may be an example of the upper side positioning member.

In the guide mechanism (the floor face guide portion 212 and the guided portion 213), the floor face guide portion 212 may be constituted by guide protrusions that are plurally arrayed along the insertion/removal direction of the image formation unit 12, and the guided portion 213 may be constituted by a guide groove that extends along the direction of arrangement of the plural guide protrusions and is relatively movably guided by the guide protrusions.

Below, the second exemplary embodiment is described in more detail. Overall structure of the image forming device relating to the second exemplary embodiment is similar to the first exemplary embodiment, so will not be described.

Image Formation Unit

Figure 10:
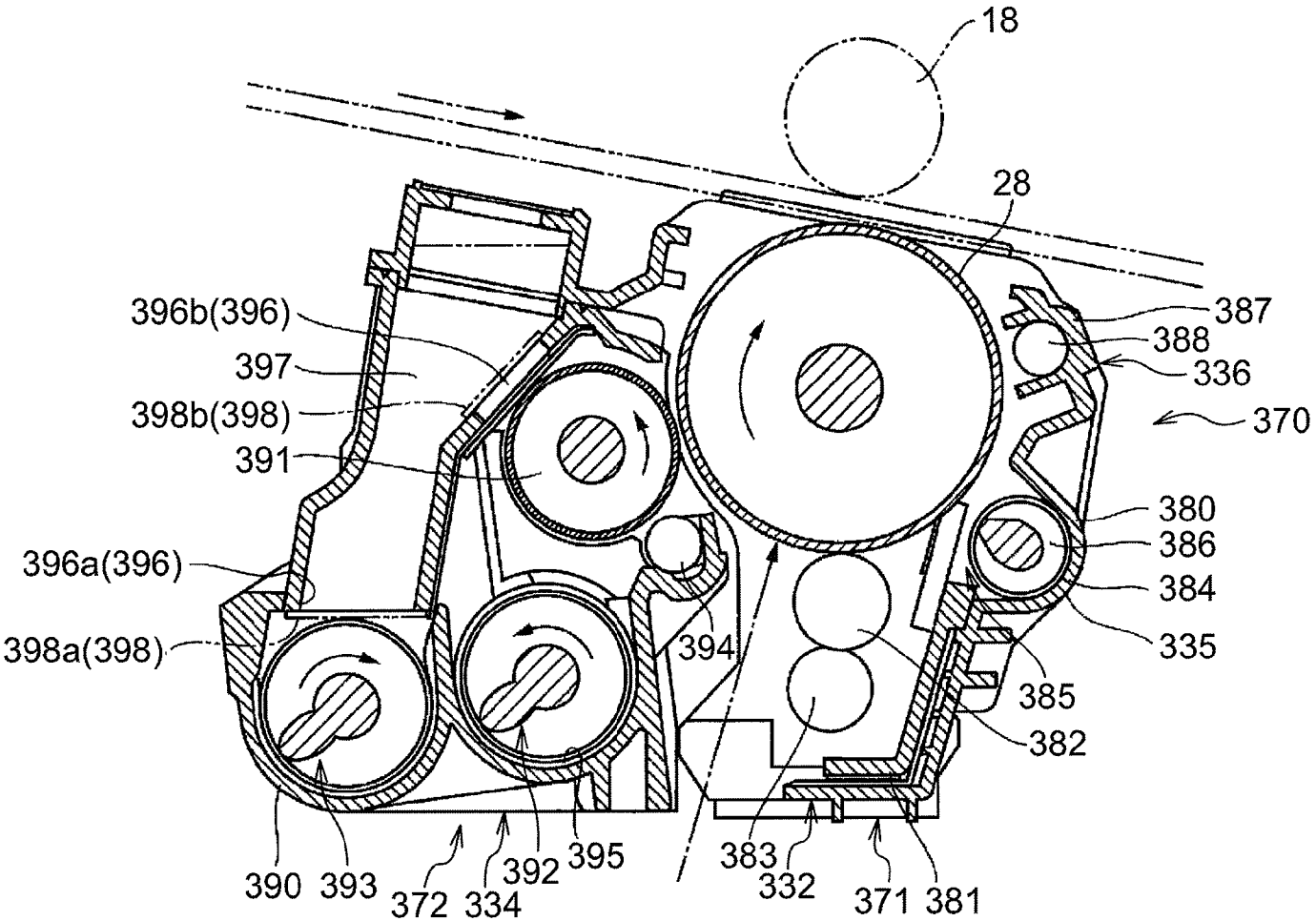
FIG. 10 is an explanatory diagram illustrating details of the image formation unit that is used in the exemplary embodiment.
Figure 11:
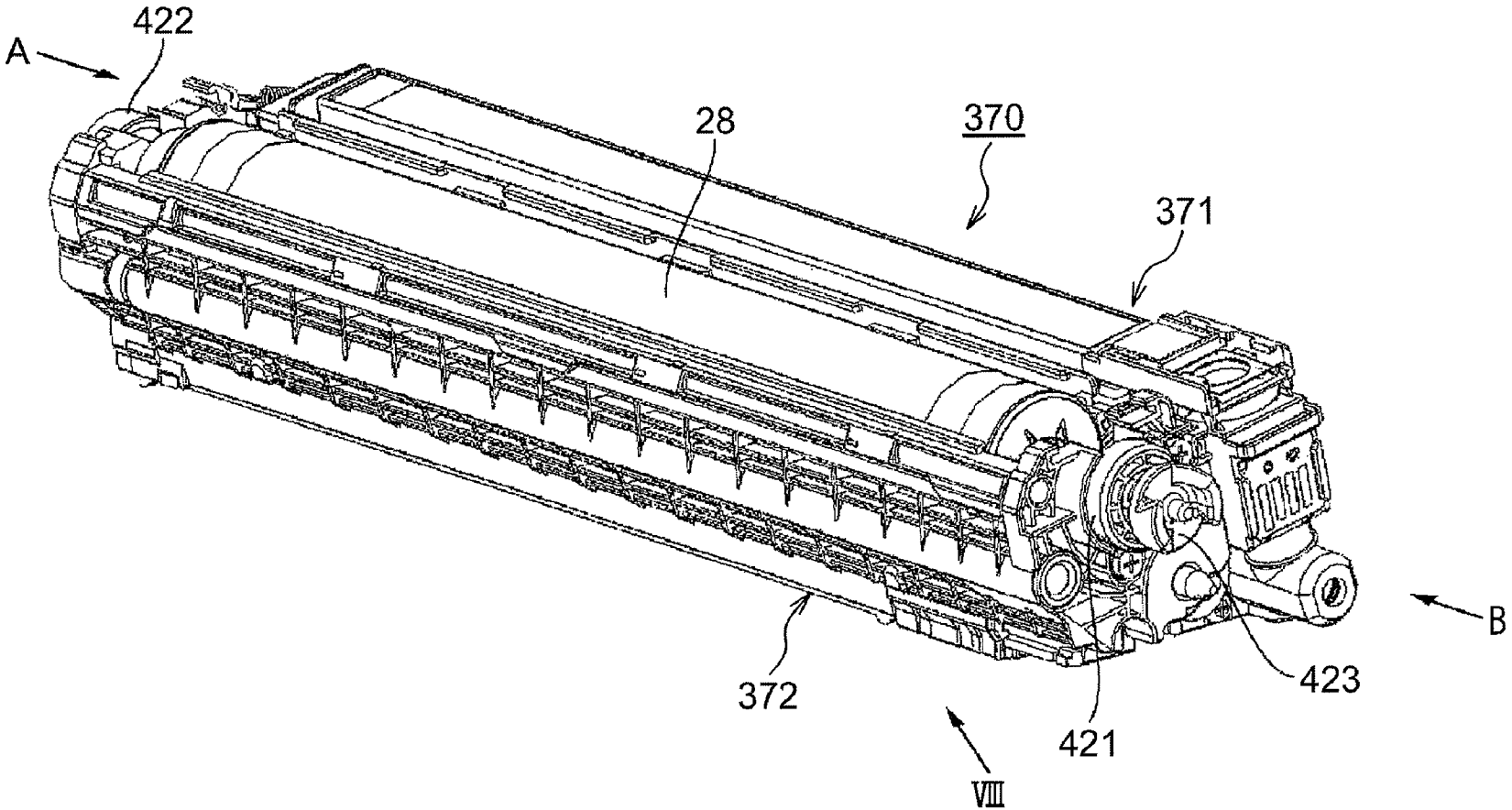
FIG. 11 is a perspective explanatory diagram of the image formation unit that is used in the exemplary embodiment.

In the second exemplary embodiment, as illustrated in FIG. 10 and FIG. 11, the photoreceptor 28 is structured as an image formation unit (process cartridge) 370 in which a charging device 332, a developing device 334, a cleaning device 335 and a charge removal device 336 are integrated. The image formation unit 370 is removably mounted in a unit holder portion of the device body 10A, and constitutes an image formation section of a respective color.

The image formation unit 370 is provided with a photoreceptor unit 371, in which the photoreceptor 28 is incorporated, and a developing unit 372, which is swingably connected to the photoreceptor unit 371 and in which the developing device 334 is incorporated.

Photoreceptor Unit

As illustrated in FIG. 10 and FIG. 11, the photoreceptor unit 371 includes an accommodation container 380 in which the photoreceptor 28 is accommodated. The charging device 332, the cleaning device 335 and the charge removal device 336 are disposed around the photoreceptor 28 in the accommodation container 380.

The photoreceptor 28 is rotatably supported, at two rotation axis ends thereof, at bearing members 421 and 422 that are provided at the two ends of the accommodation container 380. A coupling member 423, which is provided at one end of the rotation axis of the photoreceptor 28, is connected to an unillustrated driving mechanism when the image formation unit 370 is mounted.

The charging device 332 includes a charging container 381 at a portion of the accommodation container 380. A charging roller 382 and a cleaning roller 383 are disposed in the charging container 381. The charging roller 382 touches or is disposed close to the surface of the photoreceptor 28. The cleaning roller 383 cleans off toner adhering to the surface of the charging roller 382.

The cleaning device 335 includes a cleaning container 384 at a portion of the accommodation container 380. At an opening edge of the cleaning container 384, a cleaning member (cleaning blade) 385 is provided that scrapes off residual toner on the surface of the photoreceptor 28. The recovery conveyance member 386 (for example, in the form of a helical vane attached to the circumference of a rotating shaft) is provided in the cleaning container 384. The recovery conveyance member 386 conveys the residual toner scraped off by the cleaning member 385 toward a waste toner recovery device 560 (see FIG. 17).

The charge removal device 336 includes a charge removal container 387 at a portion of the accommodation container 380. A charge removal illumination lens (erasure lamp) 388 is retained at the charge removal container 387. Charge removal light from an unillustrated charge removal lamp is guided to the charge removal illumination lens 388, and the charge removal light is illuminated onto the surface of the photoreceptor 28.

Developing Unit

As illustrated in FIG. 10 and FIG. 11, the developing unit 372 includes a developing container 390, which opens toward the photoreceptor 28 and accommodates a two-component developer containing a toner and a carrier. A developing roller 391, which retains and conveys the developer, is disposed at a position facing an aperture 396*b* of the developing container 390. A pair of developer-agitating members 392 and 393 (for example, in the form of helical vanes attached to the circumferences of rotating shafts) are disposed at a rear side of the developing roller 391 in the developing container 390. A layer thickness regulation member (for example, a layer thickness regulating roller) 394 is provided at the upstream side of the rotation direction of the developing roller 391 relative to a developing position of the developing roller 391. The layer thickness regulation member 394 regulates the thickness of a layer of developer that is retained at the developing roller 391.

The developing container 390 includes a developer accommodation chamber 395 and an initial developer storage chamber 397. The developer accommodation chamber 395 accommodates developer when the image formation unit 370 is mounted, and the developing roller 391 and the developer-agitating members 392 and 393 are disposed in the developer accommodation chamber 395. The initial developer storage chamber 397 is adjacent to the developer accommodation chamber 395 via the aperture 396 (plural apertures 396*a* and 396*b* in the present example), and initial developer is stored in the initial developer storage chamber 397 before the image formation unit 370 is mounted. Before the image formation unit 370 is mounted, which is to say, when the developing unit 372 is not yet in use, the aperture 396 (396*a* and 396*b*) between the initial developer storage chamber 397 and the developer accommodation chamber 395 is closed off with a closing seal 398 (398*a* and 398*b* in the present example), which is removable at a time of use.

Installation Structure of Photoreceptor Unit and Developing Unit

Figure 12A:
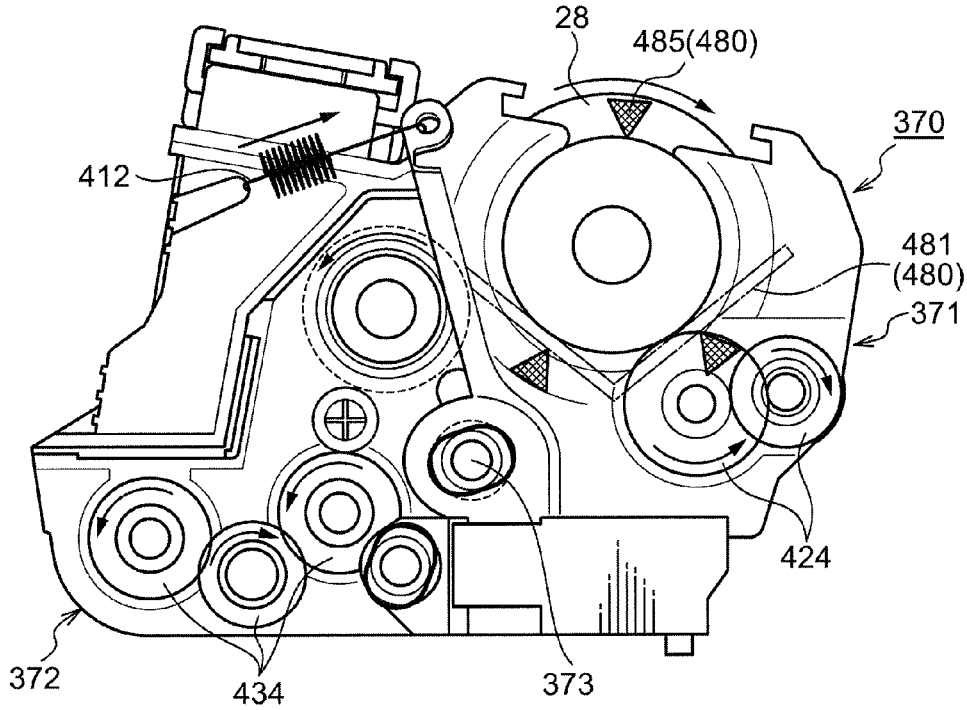
FIG. 12A is a view on an arrow seen from direction A in FIG. 11.
Figure 12B:
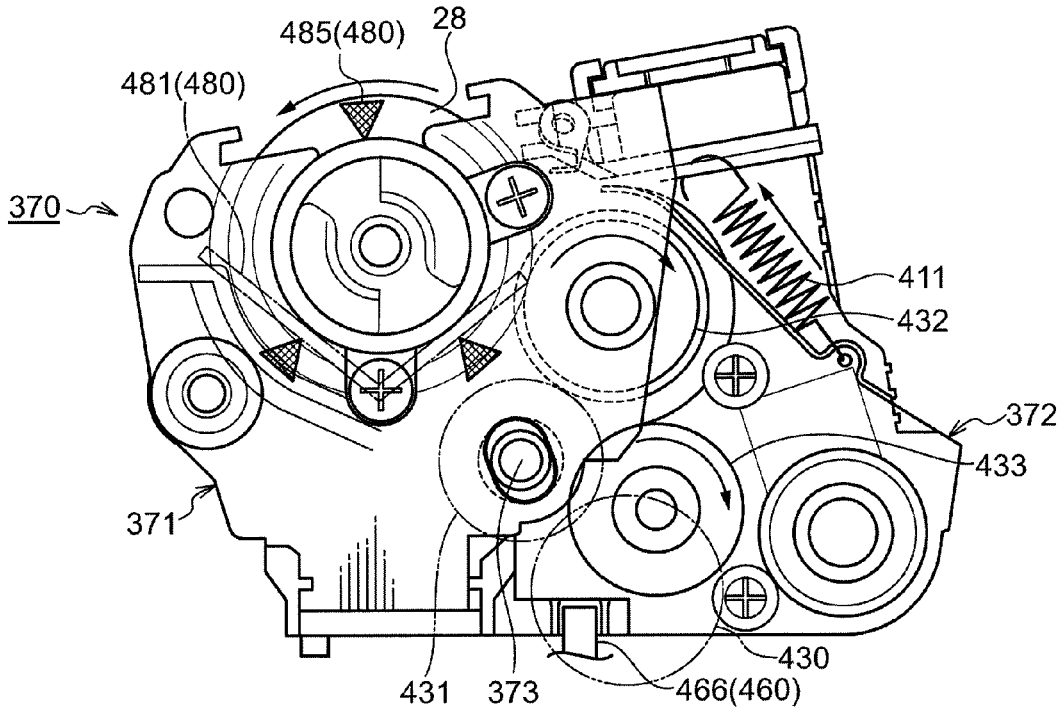
FIG. 12B is a view on an arrow seen from direction B in FIG. 11.

In the present exemplary embodiment, for example, as illustrated in FIG. 11, FIG. 12A and FIG. 12B, the photoreceptor unit 371 and the developing unit 372 are swingably supported by a connecting mechanism 373.

The connecting mechanism 373 swingably connects, at a pivot axle, the accommodation container 380 of the photoreceptor unit 371 with installation pieces at each of two length direction ends of the developing container 390 of the developing unit 372.

The connecting mechanism 373 is provided at a region away from a region of opposition between the photoreceptor 28 and the developing roller 391.

Tracking rollers for position adjustment (not shown), which are slightly larger in diameter than the developing roller 391, are provided at the two ends of the developing roller 391. A gap between the developing roller 391 and the photoreceptor 28 is adjusted to a predetermined amount that is specified beforehand, by the tracking rollers touching against the surface of the photoreceptor 28.

As illustrated in FIG. 12A and FIG. 12B, coil springs 411 and 412 are provided between the developing container 390 of the developing unit 372 and the accommodation container 380 of the photoreceptor unit 371. The coil springs 411 and 412 urge the developing roller 78 in a direction of pressing against the photoreceptor 28.

Drive Transmission System of the Image Formation Unit

A drive transmission system of the image formation unit 12 is described in accordance with FIG. 12A and FIG. 12B.

As mentioned above, the photoreceptor 28 of the photoreceptor unit 371 is driven from the coupling member 423, which is connected to an unillustrated driving mechanism, and driving force is transmitted from the photoreceptor 28 to the recovery conveyance member 386 of the cleaning device 335 via a drive transmission gear train 424.

A driving gear 430, which is driven by an unillustrated driving motor, transmits driving force to a drive transmission gear 432, for the developing roller 391 via a developing input gear 331, and to a drive transmission gear 433, for one of the developer-agitating members 392. The other of the developer-agitating members 393 is driven by driving force transmitted from the one developer-agitating member 392 via a drive transmission gear 434.

Unit Holder Portion

Figure 13:
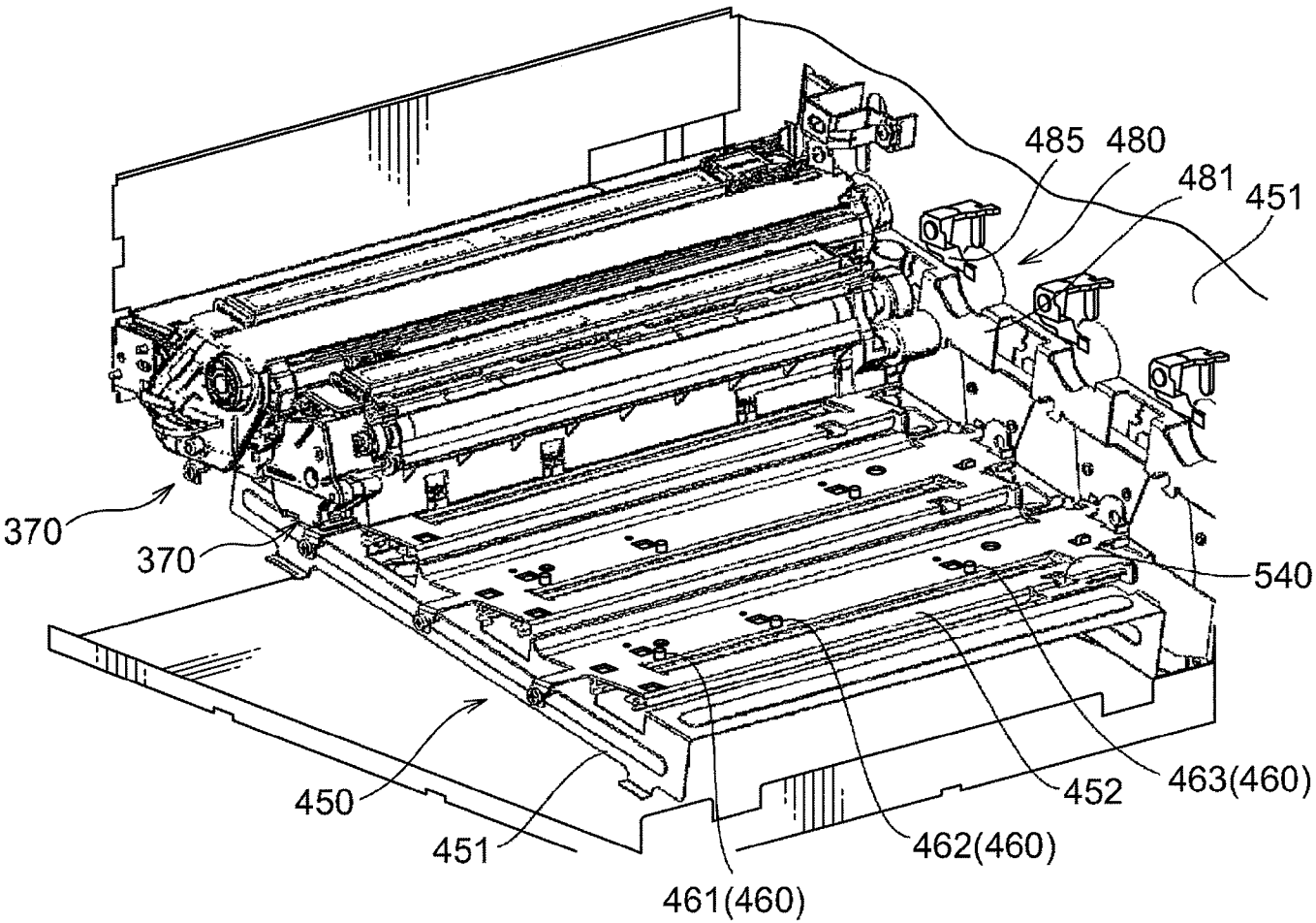
FIG. 13 is an explanatory diagram illustrating details of the holding portion of the casing of the exemplary embodiment.

As illustrated in FIG. 13, plural unit holder portions 450 are provided, at which image formation units 370 of the respective colors are mounted into the device body 10A from the outer side (user operation side) of the device body 10A.

At each unit holder portion 450, a support plate 452, at which a bottom portion of the image formation unit 370 is to be supported, is fixed to a support frame 451 of the device body 10A. Plural guide members 460 (461 to 463) are provided at the support plate 452. The guide members 460 are capable of guiding the image formation unit 370 in the insertion/removal direction. A positioning mechanism 480 is provided at a pre-specified mounting position of the support plate 452. The positioning mechanism 480 positions the bearing members 421 and 422 of the photoreceptor 28 of the image formation unit 370 when the image formation unit 370 is mounted.

Guide Members

Figure 14A:
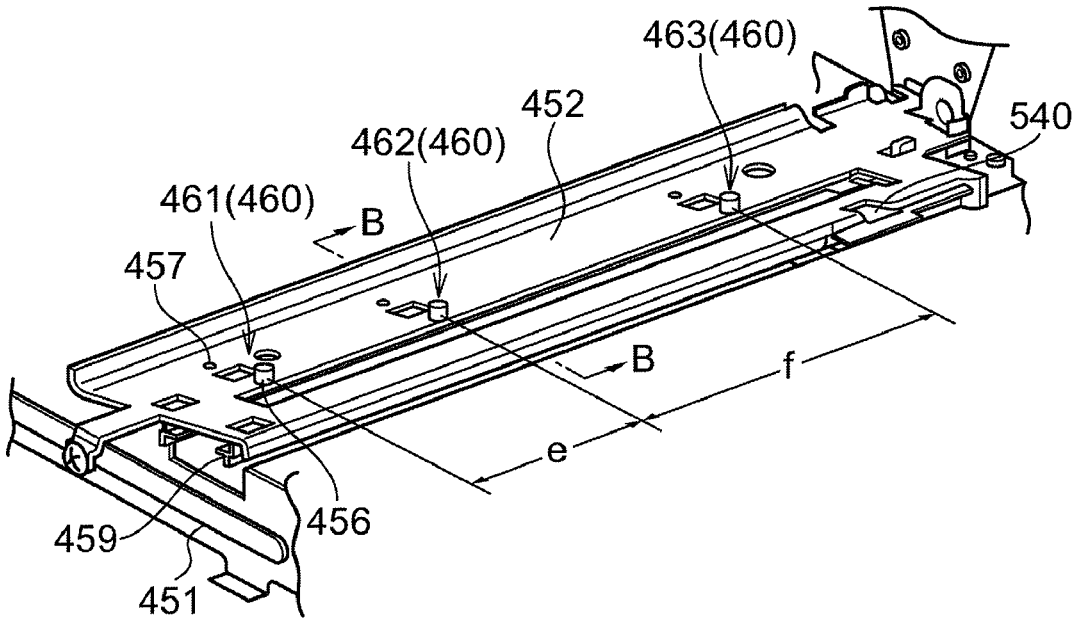
FIG. 14A is an explanatory diagram illustrating a guide portion structure of the holding portion illustrated in FIG. 13.
Figure 14B:
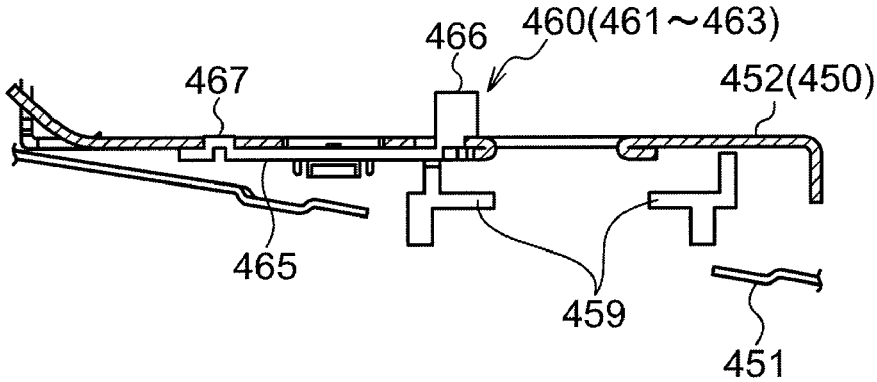
FIG. 14B is a sectional diagram corresponding to line B-B in FIG. 14A.

As illustrated in FIG. 14A and FIG. 14B, the guide members 460 (461 to 463) have guide installation plates 465 which extend in a direction that is orthogonal to the direction of guiding by the guide members 460. At each of the guide installation plates 465, a guide pin 466 is formed to integrally protrude therefrom, and a positioning protrusion 467 is formed protruding to a side of the guide installation plates 465 away from the guide pin 466.

A pin insertion hole 456 and a positioning hole 457 are opened in the support plate 452. The guide pin 466 is inserted into the pin insertion hole 456, and the positioning protrusion 467 fits into the positioning hole 457 so as not to protrude from the surface of the support plate 452. A guide rail is provided at a lower side of the support plate 452. A cleaning member that cleans the exposure unit 40 (see FIG. 8) is guided by the guide rail.

For the second exemplary embodiment, the guide member 460 (461 to 463) is disposed at the rear face side of the support plate 452, and the guide installation plate 465 is fixed to the support plate 452 by the guide pin 466 being inserted into the pin insertion hole 456 of the support plate 452 and then slightly moved so as to pull the guide pin 466 against the edge of the pin insertion hole 456, and the positioning protrusion 467 being inserted into the positioning hole 457.

Herein, an assembly structure of the guide members 460 is not limited thus. Unillustrated fastening fixtures may be used, and suitable structures in which resiliently deformable press-fastening portions are formed at portions of the guide installation plates 465 or the like are possible.

In the second exemplary embodiment, similarly to the first exemplary embodiment, spacings between the guide pins 466 of the guide members 460 (461 to 463) are specified to be non-uniform. For example, if a distance between the guide pins 466 of the guide members 461 and 462 is defined as e, and a distance between the guide pins 466 of the guide members 462 and 463 is defined as f, these are specified such that the relationship $e<f$ is satisfied. Dimensional relationships herein are not to be limited thus. For example, they may be specified so as to satisfy the relationship $e>f$.

Positioning Mechanism

The positioning mechanism 480 is provided at the support frame 451 that is disposed at the insertion/removal direction inner side of the image formation unit 370 when the image formation unit 370 is mounted at the mounting position in the unit holder portion 450.

Figure 20:
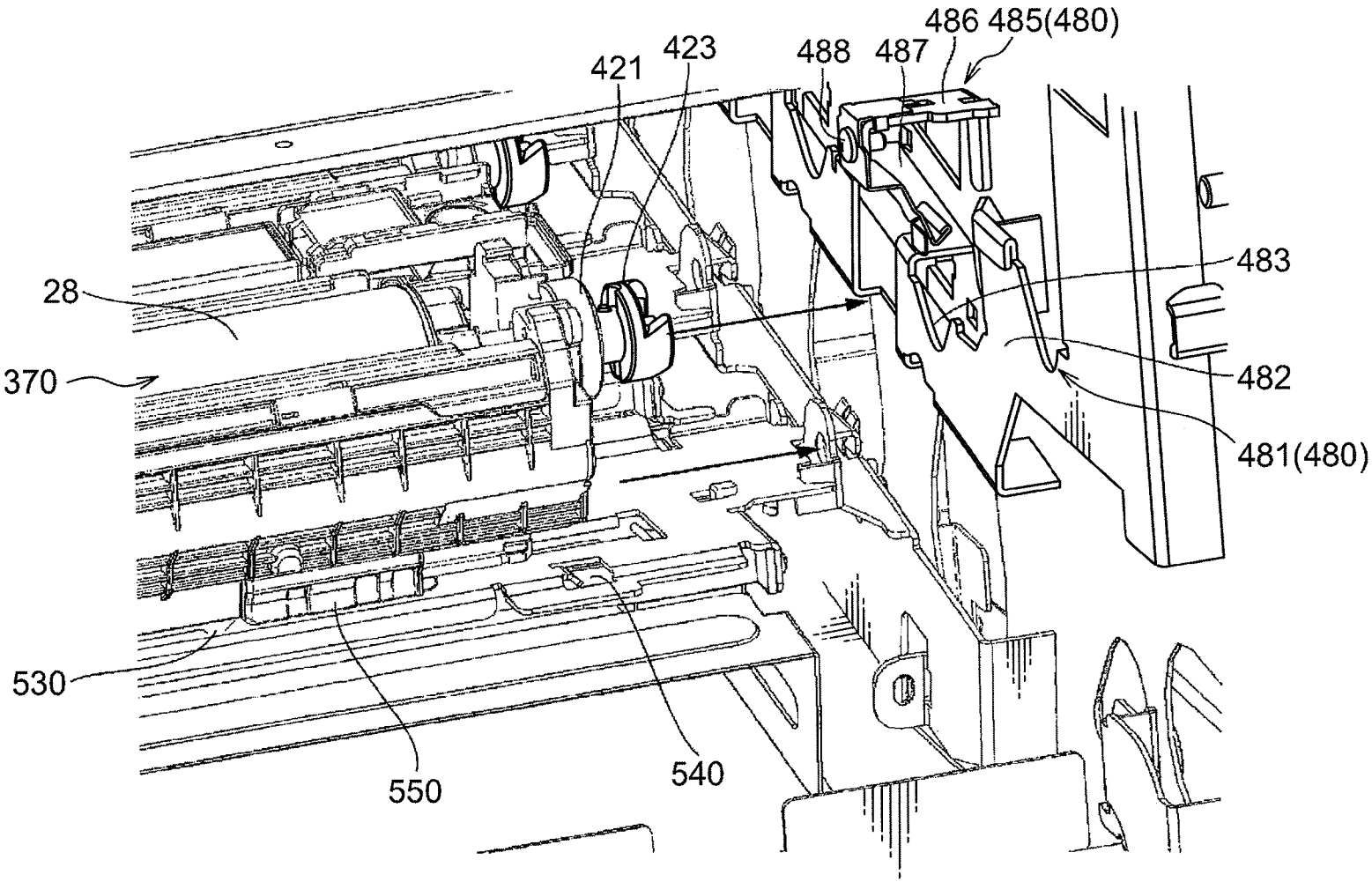
FIG. 20 is an explanatory diagram illustrating movement before the image formation unit used in the exemplary embodiment is mounted at the mounting position of the holding portion of the casing.

As illustrated in FIG. 13 and FIG. 20, the positioning mechanism 480 is provided with a lower side positioning member 481 and an upper side positioning member 485. The lower side positioning member 481 positions and supports the bearing member 421 of the image formation unit 370. The upper side positioning member 485 resiliently presses down and positions the bearing member 421, which is positioned at the lower side positioning member 481, from the upper side thereof.

At the lower side positioning member 481, a positioning plate 482 with a substantially V-shaped groove 483 is fixed to a portion of the support frame 451. The bearing member 421 of the image formation unit 370 is supported at two points by the substantially V-shaped groove 483 (see FIG. 12A).

At the upper side positioning member 485, a bracket 486 is fixed to the support frame 451, and a plate spring 487 is fixed to the bracket 486 by a stopper 488 to be swingable with a small margin of free play.

The plate spring 487 comes into contact with the coupling member 423 when the coupling member 423 passes the position of the lower side positioning member 481 in a non-contacting state. At this time, passage of the coupling member 423 is allowed with the margin of free play. When the bearing member 421 reaches the position of the lower side positioning member 481 and is positioned at the two points, the plate spring 487 presses on one point at the upper side of the bearing member 421 with a resilient urging force (see FIG. 12A).

In the present exemplary embodiment, an unillustrated positioning mechanism is also provided at the insertion direction outer side of the image formation unit 370. In the state in which the image formation unit 370 is disposed at the mounting position in the unit holder portion 450, the bearing member 422 at the insertion direction outer side of the image formation unit 370 is positioned by the unillustrated positioning mechanism, which is provided at an opening/closing door for positioning (not shown), by the opening/closing door being closed.

Image Formation Unit Guide Structure

Figure 15:
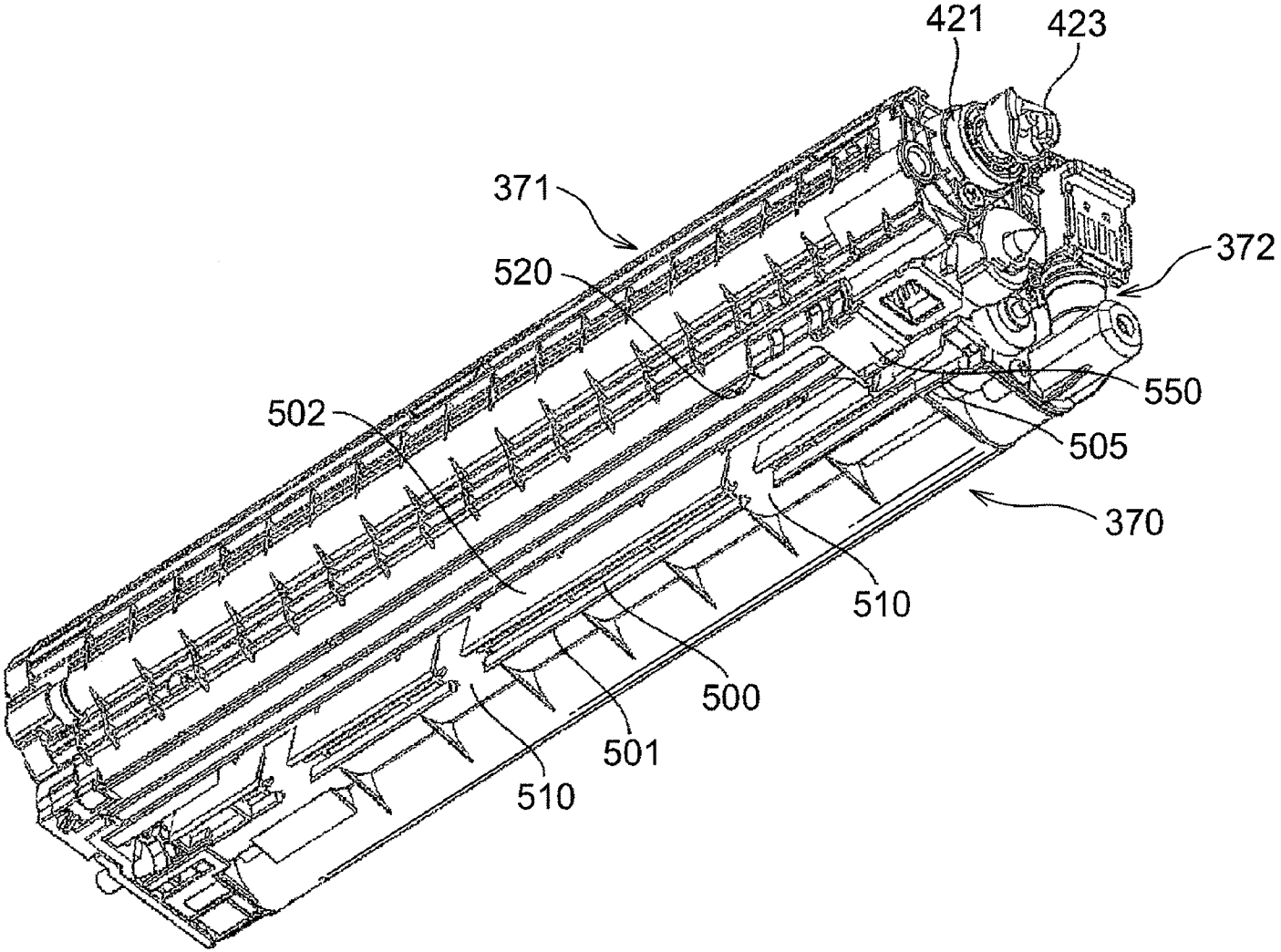
FIG. 15 is a view on an arrow seen from direction VIII in FIG. 11.
Figure 16:
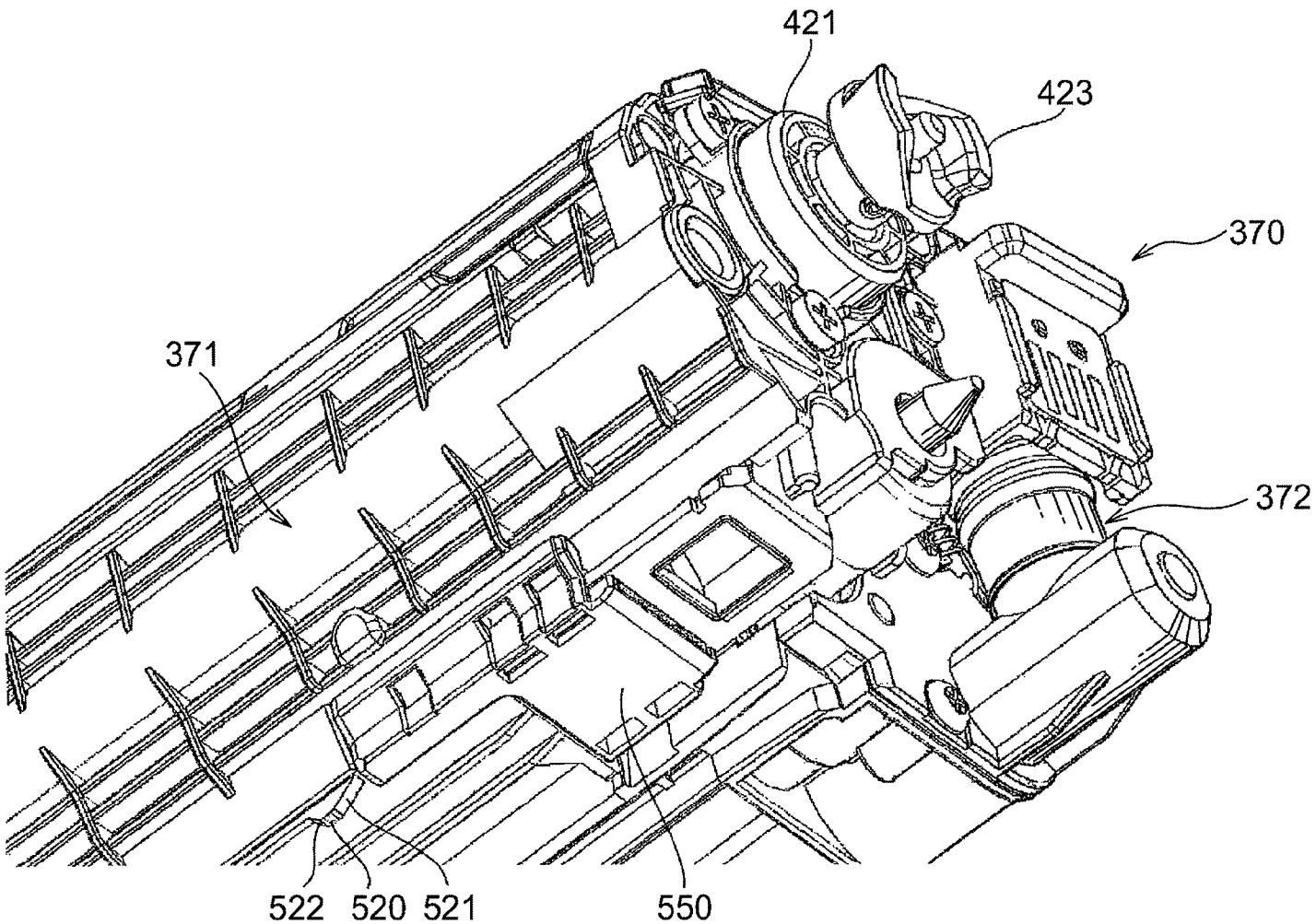
FIG. 16 is a perspective view of principal elements of the image formation unit illustrated in FIG. 8.

As illustrated in FIG. 15 and FIG. 16, a guide groove 500 is provided at the image formation unit 370 in a bottom portion of the developing container 390 of the developing unit 372. The guide groove 500 slidably movably guides the guide pins 466 of the guide members 460 (461 to 463) of the unit holder portion 450. The guide groove 500 is formed between a pair of guide plates 501 and 502 that extend along the direction of arrangement of the guide pins 466. Notches 510, through which the guide pins 466 are passable, are formed at portions of one of the guide plates 501 and 502 that correspond with the guide pins 466 of the guide members 460 (461 to 463) in the state in which the image formation unit 370 has been inserted and mounted at the mounting position of the unit holder portion 450.

A region of the pair of guide plates 501 and 502 that form the guide groove 500, at the insertion distal end of the image formation unit 370, is formed as a spreading taper portion 505 that widens toward an entrance thereof. Thus, the guide pins 466 are guided into the guide groove 500.

Insertion Attitude Regulation

An insertion attitude regulation protrusion 520 is formed at the image formation unit 370, at the bottom portion of the accommodation container 380 of the photoreceptor unit 371.

The insertion attitude regulation protrusion 520 is singly provided at the insertion distal end side of the image formation unit 370. In the present exemplary embodiment, the insertion attitude regulation protrusion 520 is formed in a substantially trapezoid shape in cross section, with inclined portions 521 and 522 before and after in the insertion/removal direction of the image formation unit 370.

The insertion attitude regulation protrusion 520 regulates the insertion attitude of the image formation unit 370 such that the insertion distal end side of the image formation unit 370 is lifted up when the image formation unit 370 slidably moves along the insertion/removal direction of the support plate 452 of the unit holder portion 450. A height of the insertion attitude regulation protrusion 520 is set to a level such that the bearing member 421 at the insertion distal end side of the image formation unit 370 does not touch the lower side positioning member 481 of the positioning mechanism 480 when the bearing member 421 reaches the position of the lower side positioning member 481.

A recess hole 540 is provided at the support plate 452 of the unit holder portion 450. The insertion attitude regulation protrusion 520 fits into the recess hole 540 when the state in which the image formation unit 370 is disposed at the mounting position in the unit holder portion 450 is reached. (FIG. 20). When the insertion attitude regulation protrusion 520 fits into the recess hole 540, the insertion attitude of the image formation unit 370 adopts an attitude along the support plate 452 of the unit holder portion 450. At this time, the bearing member 421 at the insertion distal end side of the image formation unit 370 is disposed to touch against the lower side positioning member 481.

A guide incline portion 541 is provided at an edge portion of the recess hole 540 at the removal direction side thereof in the insertion/removal direction of the image formation unit 370. As illustrated in FIG. 20 and FIG. 23C, the guide incline portion 541 has an inclination substantially corresponding with the inclined portion 521 of the insertion attitude regulation protrusion 520.

Relationship Between Image Formation Unit and Waste Toner Recovery Device

Figure 17:
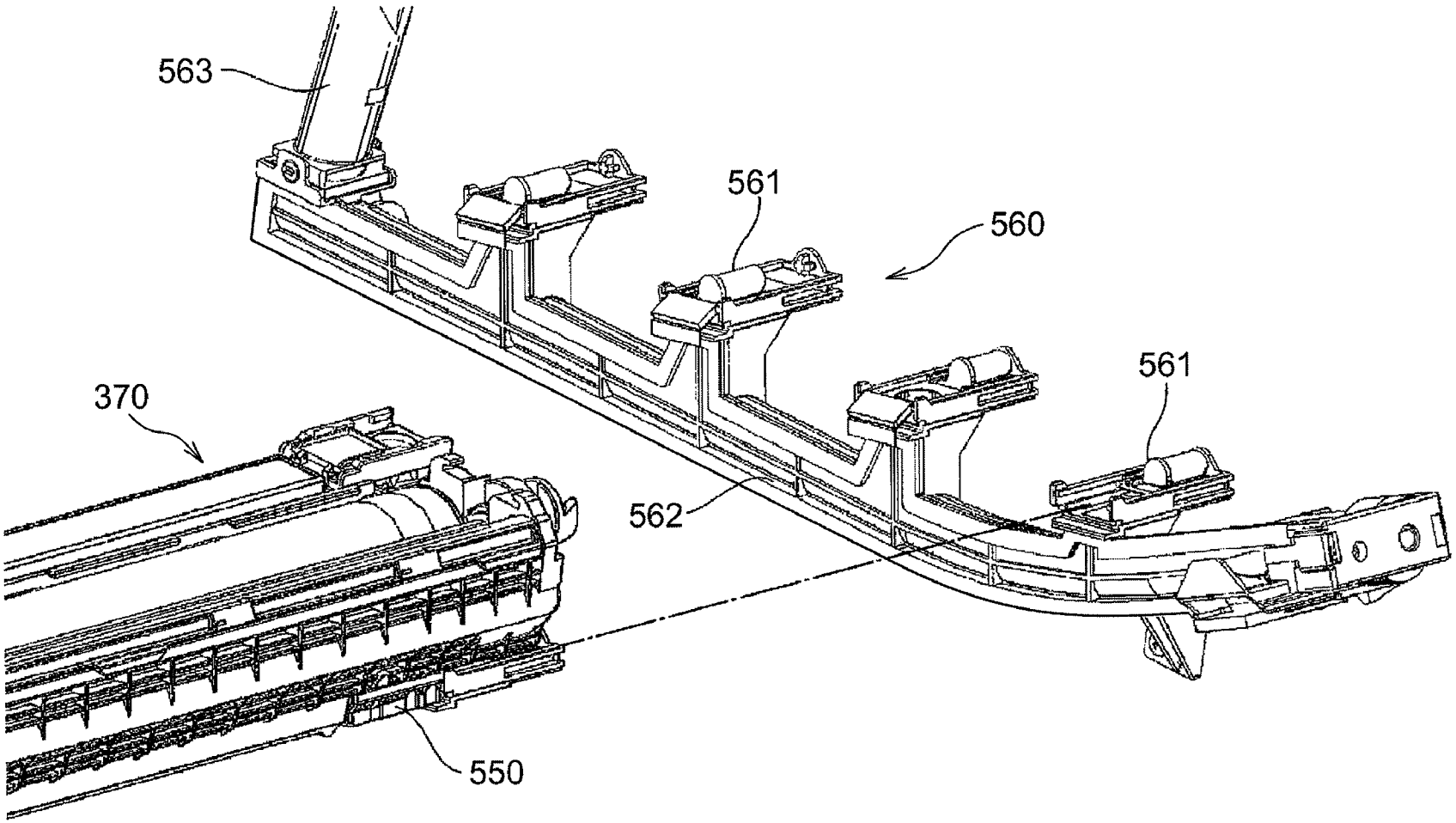
FIG. 17 is an explanatory diagram illustrating a relationship between the image formation unit used in the exemplary embodiment and a waste toner recovery device.

As illustrated in FIG. 15 to FIG. 17, the photoreceptor unit 371 of the image formation unit 370 accommodates the cleaning device 335, and a shutter 550 is provided at one end of the recovery conveyance member 386 of the cleaning device 335. The shutter 550 is provided at the insertion distal end side of the image formation unit 370. The image formation unit 370 of each color is structured so as to, when mounted at the mounting position in the unit holder portion 450, correspond with a recovery collector 561 of the respective color of the waste toner recovery device 560 and connect therewith in a state in which the shutter 550 is opened.

The waste toner recovery device 560 includes the recovery collectors 561 at suitable positions of a recovery piping 562. A conveyance duct 563, through which waste toner is conveyed from the cleaning device 30, is connected to one end of the recovery pipe 562, and an unillustrated recovery container is connected to the other end of the recovery pipe 562. A helical conveyance member (not shown), at which a helical vane is formed around a rotating shaft, is disposed inside the recovery pipe 562.

The insertion attitude regulation protrusion 520 is provided in a vicinity of the shutter 550. When the insertion attitude regulation protrusion 520 is disposed so as to touch against the support plate 452 of the unit holder portion 450, the shutter 550 is not in contact with the support plate 452.

In the drawings, each shutter 550 of the cleaning device 335 is drawn as a schematic diagram at a position at which the aperture is opened. In practice however, the shutter 550 is opened at a position corresponding with the recovery collector 561 of the waste toner recovery device 560 when the image formation unit 370 is disposed at the mounting position of the unit holder portion 450.

Operation of the Second Exemplary Embodiment

Operation of Mounting an Image Formation Unit

Figure 18:
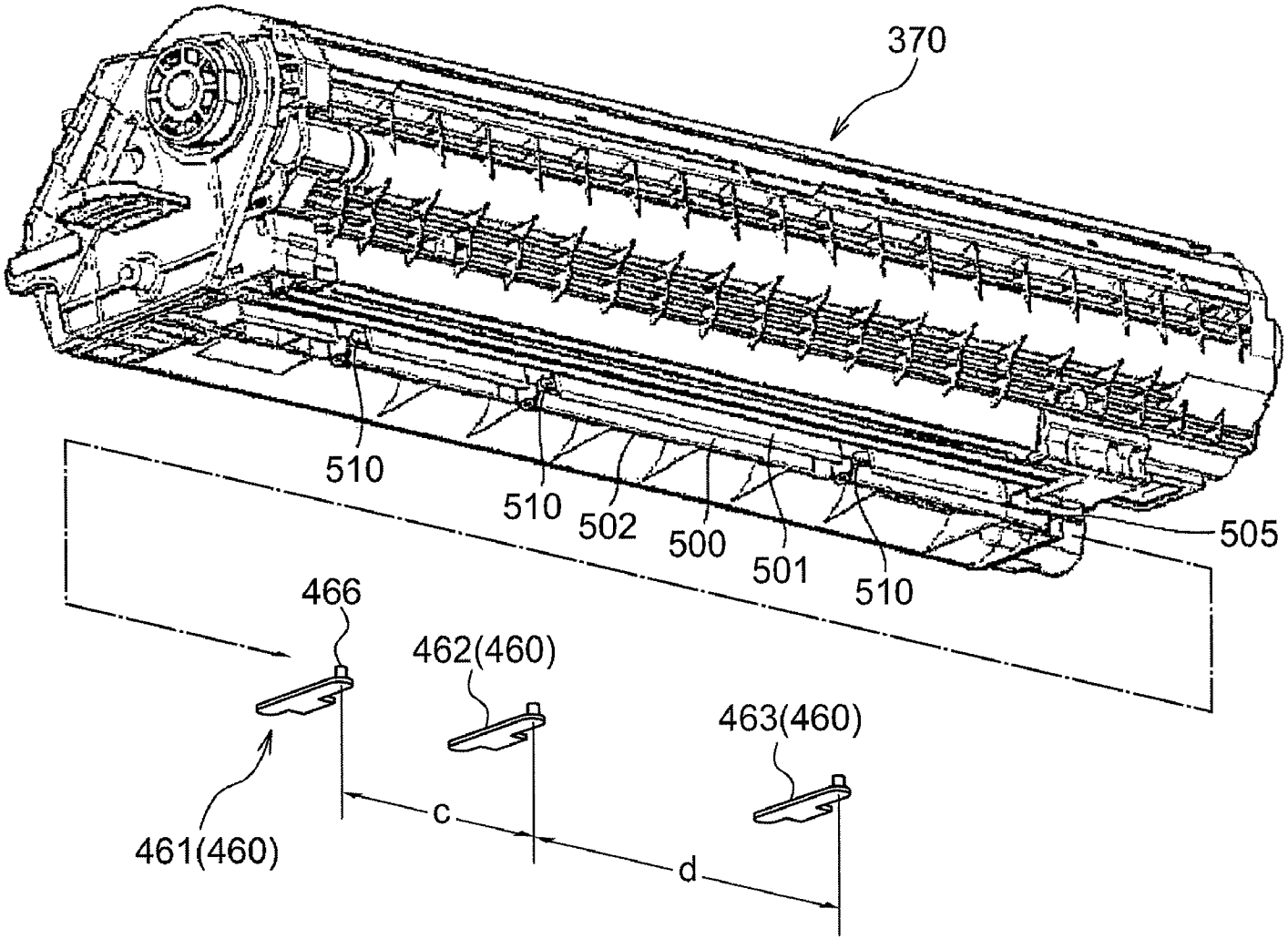
FIG. 18 is an explanatory diagram illustrating a guide movement process of the image formation unit used in the exemplary embodiment.
Figure 23A:
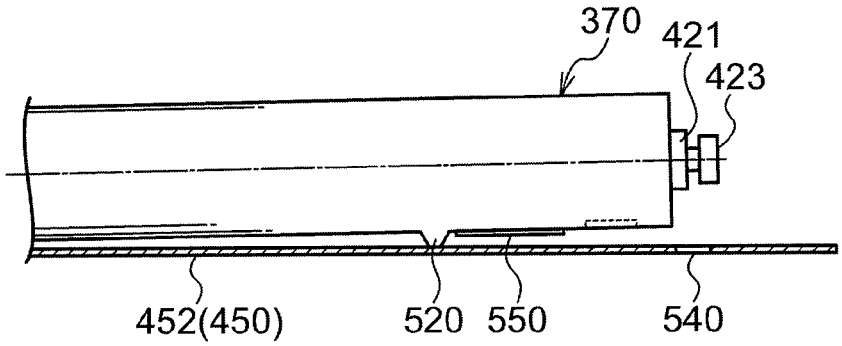
FIG. 23A is an explanatory diagram schematically illustrating a state of the image formation unit with respect to the holding portion of the casing of FIG. 20.

As illustrated in FIG. 11, FIG. 18 and FIG. 23A, when the image formation unit 370 is inserted and mounted at the unit holder portion 450, the guide pins 466 of the guide members 460 (461 to 463) of the unit holder portion 450 are guided into the guide groove 500 of the image formation unit 370. In this state, the image formation unit 370 is moved to the prespecified mounting position while touching the top of the support plate 452 of the unit holder portion 450.

Here, the guide mechanism (the guide members 460 and the guide groove 500) is provided with spacings between the guide pins 466 being non-uniform. Therefore, while the guide groove 500 moves along the direction of arrangement of the guide pins 466, the image formation unit 370 is guided by the guiding mechanism until reaching the mounting position in the unit holder portion 450, without the guide pins 466 disengaging from the notches 510 of the guide groove 500.

Figure 19A:
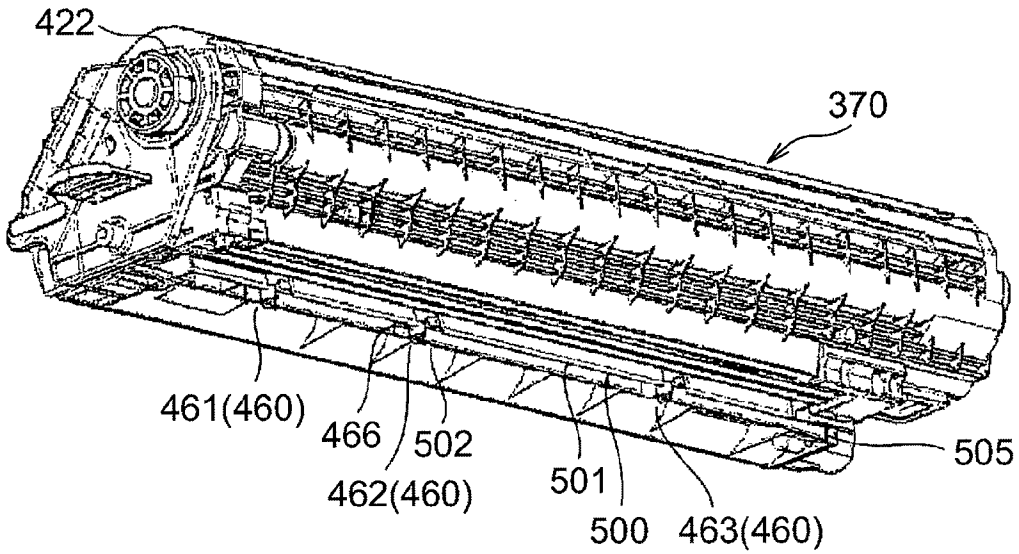
FIG. 19A is an explanatory diagram illustrating a state when the image formation unit used in the exemplary embodiment is mounted at the mounting position of the holding portion of the casing.
Figure 19B:
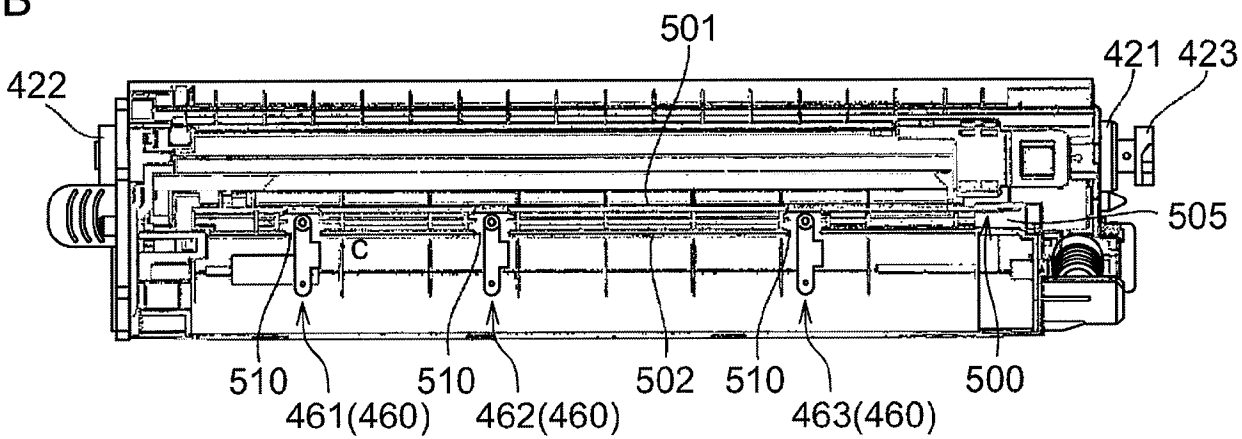
FIG. 19B is a view on an arrow seen from direction B in FIG. 19A.

When the image formation unit 370 reaches the mounting position of the unit holder portion 450, as illustrated in FIG. 19A and FIG. 19B, the guide pins 466 of the guide members 460 (461 to 463) are disposed at positions corresponding with the notches 510 of the guide groove 500. Therefore, as illustrated in FIG. 12A and FIG. 12B, while the developing unit 372 is pulled toward the photoreceptor unit 371 by the urging force of the coil springs 411 and 412, movement of the developing unit 372 relative to the guide pins 466 is allowed, via the notches 510 of the guide groove 500.

Furthermore, as illustrated in FIG. 23A, when the image formation unit 370 moves along the support plate 452 of the unit holder portion 450 while touching thereagainst, the insertion attitude regulation protrusion 520 of the image formation unit 370 moves while touching against the support plate 452. Therefore, the insertion attitude of the image formation unit 370 is adjusted to the state in which the insertion distal end side thereof is lifted up.

Figure 21:
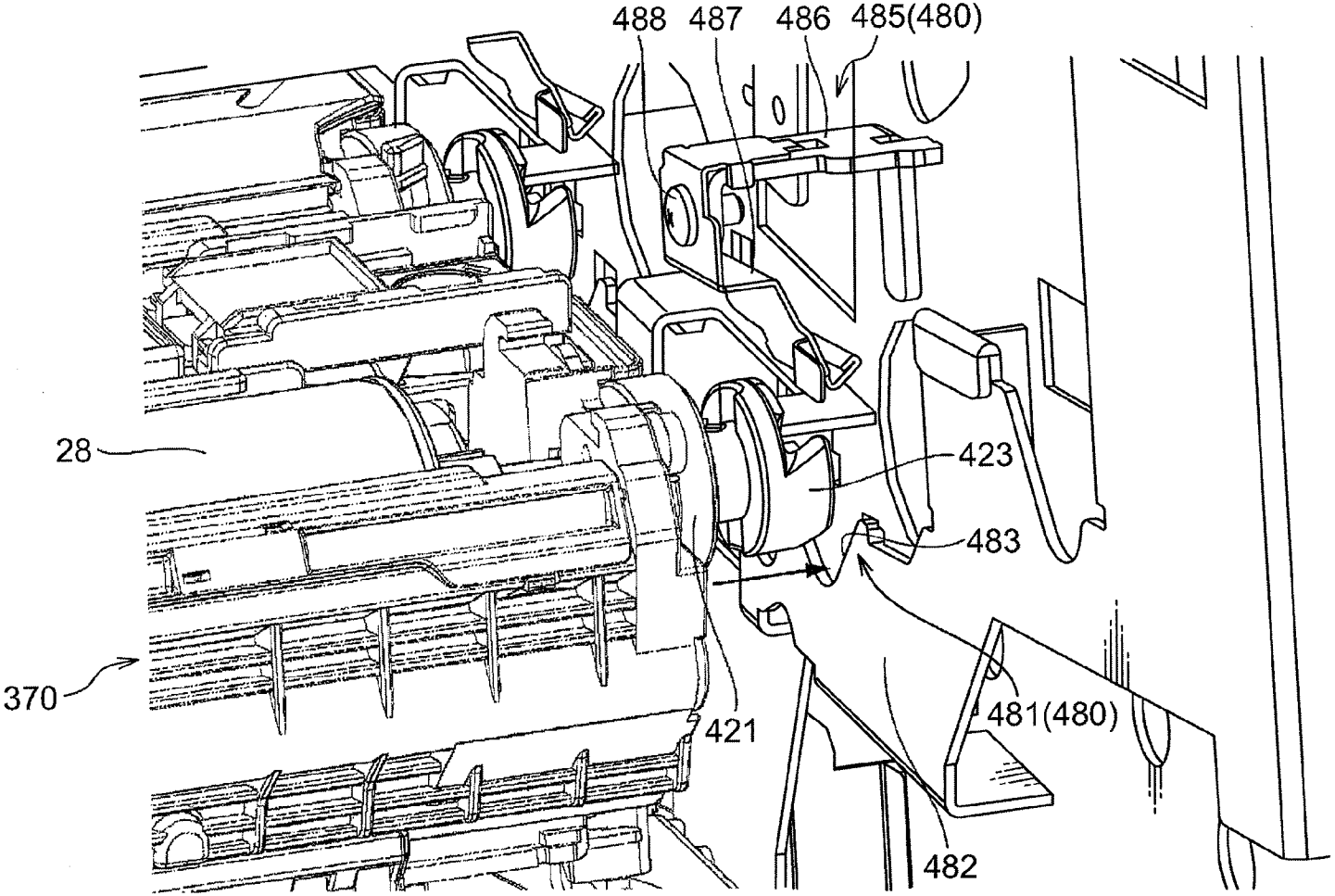
FIG. 21 is an explanatory diagram illustrating a state just before a positioned portion of the image formation unit used in the exemplary embodiment reaches a positioning portion of the casing.

In this state, when the image formation unit 370 is inserted further, firstly, as illustrated in FIG. 21, the coupling member 423 disposed at the distal end of the image formation unit 370 moves without touching the upper side of the lower side positioning member 481 of the positioning mechanism 480, and passes by the upper side positioning member 485 in a state of pushing the same up to the extent of the margin of free play.

Figure 22:
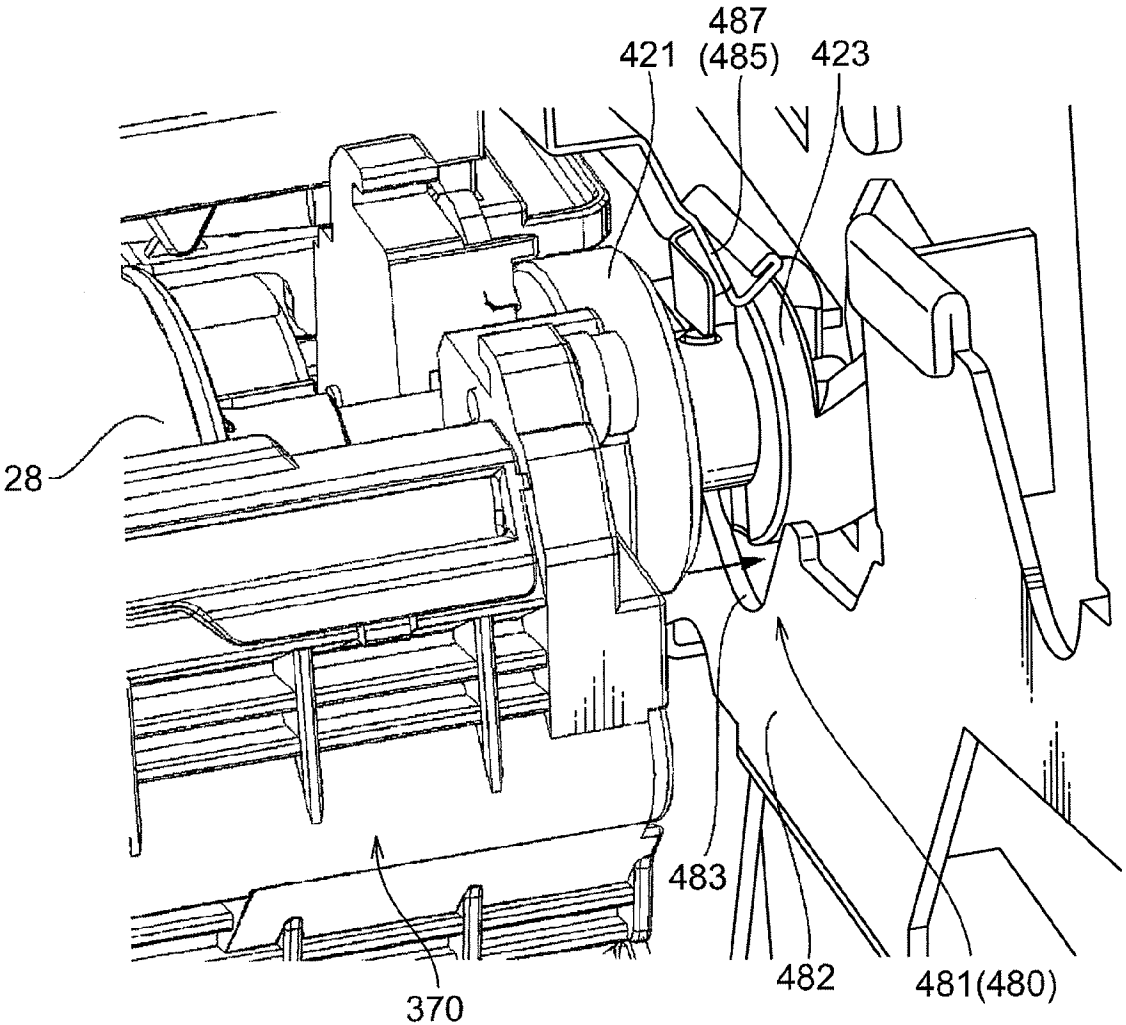
FIG. 22 is an explanatory diagram of principal elements illustrating the state just before the positioned portion of the image formation unit illustrated in FIG. 21 is positioned at the positioning portion of the casing.

Subsequently, when the bearing member 421 of the image formation unit 370 reaches the position corresponding with the lower side positioning member 481, as illustrated in FIG. 22, the bearing member 421 is disposed without touching above the lower side positioning member 481, and is disposed to touch against the plate spring 487 of the upper side positioning member 485 in opposition to urging force from the plate spring 487.

Figure 23B:
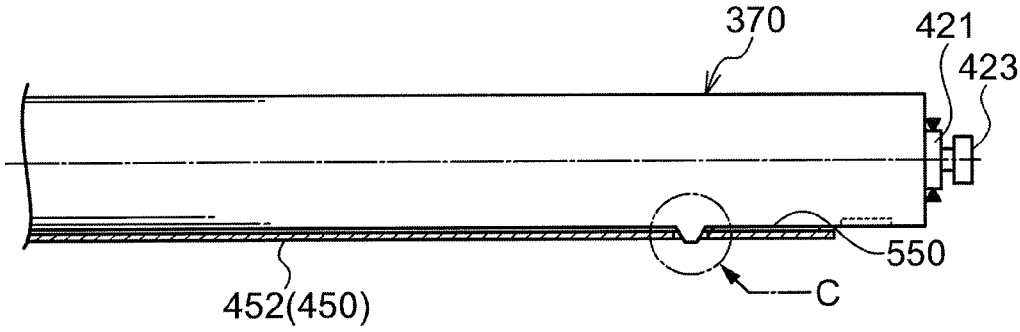
FIG. 23B is an explanatory diagram illustrating a state of the image formation unit with respect to the holding portion of the casing when the positioned portion of the image formation unit is positioned at the positioning portion of the casing.
Figure 23C:
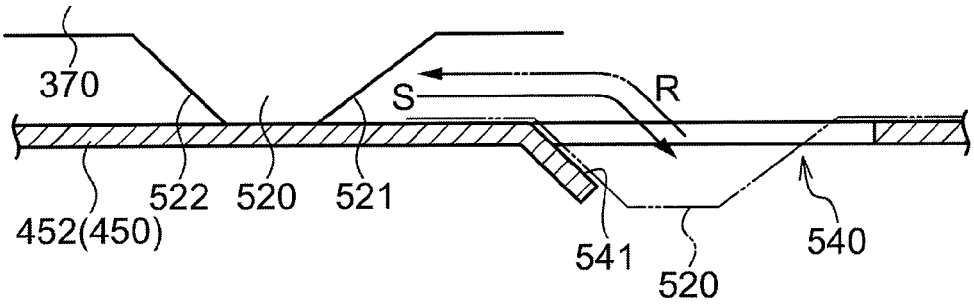
FIG. 23C is a magnified explanatory diagram of portion C in FIG. 23B.

In this state, as illustrated by FIG. 23B and the solid line S in FIG. 23C, the insertion attitude regulation protrusion 520 fits into the recess hole 540. Therefore, the insertion attitude of the image formation unit 370 returns from the lifted-up attitude to the attitude that is aligned with the support plate 452 (a substantially horizontal attitude). In association therewith, the bearing member 421 of the image formation unit 370 touches against the lower side positioning member 481 and is positioned, and is pushingly urged by the plate spring 487 of the upper side positioning member 485 and positioned.

At this stage, the image formation unit 370 is in a state of being positioned and mounted at the mounting position of the unit holder portion 450.

Operation of Removing an Image Formation Unit

When the image formation unit 370 is to be removed from the unit holder portion 450, the unillustrated opening/closing cover is opened, positioning of the image formation unit 370 in the region of the opening/closing cover is released, and then the image formation unit 370 is pulled out in the removal direction.

At this time, as illustrated by the single dot chain line R in FIG. 23C, the insertion attitude regulation protrusion 520 is removed from the recess hole 540 by the guide incline portion 541 of the recess hole 540. Hence, the image formation unit 370 proceeds to move along the support plate 452 of the unit holder portion 450 with the distal end side thereof staying in the lifted-up attitude, and is pulled out from the mounting position of the unit holder portion 450.

The shutter 550 of the cleaning device 335 returns to the closed state during removal of the image formation unit 370. Therefore, there is no concern about waste toner leaking from the image formation unit 370.

What is claimed is:

1. A replacement unit comprising:

a bottom member; and a guide groove provided in the bottom member and extending in an installation direction along which the replacement unit is installed in a device body, the guide groove for receiving a plurality of protrusions of a support member of the device body; and a plurality of notches which correspond respectively to the protrusions of the support member, each of the notches extending in a orthogonal direction orthogonal to the installation direction, wherein after the replacement unit has been installed into the device body, the notches oppose the protrusions and the replacement unit is movable in the orthogonal direction.

2. The replacement unit according to claim 1, wherein the guide groove comprises a guiding-in portion that guides in the protrusions when the replacement unit is installed in the device body.

3. The replacement unit according to claim 1, further comprising:

a photoreceptor unit including an image-holding member at a surface of which an electrostatic latent image is formed; and a developing unit including a developing member which supplies toner to the electrostatic latent image formed at the surface of the image-holding member, and that is heavier than the photoreceptor unit, wherein the guide groove is provided in a bottom member of the developing unit.

4. The replacement unit according to claim 3, further comprising:

a shaft member that supports the photoreceptor unit and the developing unit to be relatively rotatable when the replacement unit has been installed in the device body;

a driving transmission member provided at the developing unit;

a driven member that is accommodated inside the developing unit, and rotates due to rotary force being transmitted to the driven member by the driving transmission member, wherein the plurality of notches allow movement of the developing unit relative to the protrusions when the photoreceptor unit and developing unit relatively rotate about the shaft member due to reactive force when the driving transmission member is driven.

5. The replacement unit according to claim 3, further comprising:

an aperture through which toner to be charged into the interior of the developing unit is received; and a closing member that closes the aperture and that, when the replacement unit is installed in the device body, comes into contact with an opening member provided at the device body and moves, opening the aperture and enabling receipt of the toner, wherein a position of the closing member is determined such that the opening member opens the closing member after all of the protrusions have passed the guiding-in portion.

6. The replacement unit according to claim 1, wherein spacings between the plurality of notches are respectively different.

7. The replacement unit according to claim 6, wherein the notches are three in number, and a spacing between a first notch and a second notch from an installation direction outer side of the replacement unit is narrower than a spacing between the second notch and a third notch.

8. An image forming device comprising:

a replacement unit comprising:

a bottom member; and a guide groove provided in the bottom member and extending in an installation direction along which the replacement unit is installed in a device body from sideward of the device body, the guide groove for receiving a plurality of protrusions disposed in a row on a support member of the device body, wherein the plurality of protrusions are disposed in the row in the installation direction, and spacings between the plurality of protrusions are respectively different.

9. The image forming device according to claim 8, wherein the protrusions are three in number, and the spacing between a first protrusion and a second protrusion from an installation direction outer side of the replacement unit is narrower than the spacing between the second protrusion and a third protrusion.

10. A replacement unit comprising:

a bottom member; and a guide groove provided in the bottom member and extending in an installation direction along which the replacement unit is installed in a device body from sideward of the device body, the guide groove for receiving a plurality of protrusions disposed in a row on a support member of the device body;

a positioned portion that protrudes from an installation direction distal end of the replacement unit and that, when the replacement unit is inserted to an installation position in a holding portion of the device body, is positioned at a positioning portion that is provided at least at a guide direction inner side of a bottom face guide portion of the holding portion; and an insertion attitude adjustment portion that is provided on the bottom member and that, when the replacement unit is inserted toward the installation position of the holding portion, touches against a floor face of the holding portion and moves and, in a state in which an attitude of the replacement unit is adjusted such that a positioned portion side thereof is lifted up, enables insertion of the positioned portion into the positioning portion.

11. The replacement unit according to claim 10, further comprising a rotatable image-holding member that bears an image, wherein the positioned portion comprises a support member that rotatably supports the image-holding member.

12. The replacement unit according to claim 10, wherein the insertion attitude adjustment portion is a protrusion provided at the positioned portion side of the bottom member of the replacement unit.

13. The replacement unit according to claim 10, further comprising:

a recovery device capable of recovering, of material that forms an image, residual material after image formation;

a discharge aperture that is provided at the bottom member and is capable of discharging the recovered residual material; and an opening/closing cover that covers the discharge aperture, wherein the insertion attitude adjustment portion is provided in a vicinity of the opening/closing cover.

14. An image forming device comprising:

a device body;

a holding portion formed in the device body; and a replacement unit according to claim 10, wherein the holding portion includes:

a guide portion that is provided at a floor face of the holding portion and that guides the replacement unit along the installation direction of the replacement unit; and the positioning portion that is provided at the guide direction inner side of the guide portion.

15. The image forming device according to claim 14, wherein the holding portion includes a concavity at which the insertion attitude adjustment portion can be fit in, at a location that corresponds with the insertion attitude adjustment portion in a state in which the replacement unit is mounted at a mounting position of the holding portion, and the attitude of the replacement unit is set to an attitude positioned at the positioning portion.

16. The image forming device according to claim 15, wherein at least one of the insertion attitude adjustment portion and an edge portion of the concavity includes a guide incline portion, for removing the replacement unit from the state in which the insertion attitude adjustment portion is fit in at the concavity when the replacement unit is being removed from the mounting position.

17. The image forming device according to claim 14, wherein the positioning portion comprises a lower side positioning member that catches on the positioned portion of the replacement unit from below in a positioned state, and an upper side positioning member that resiliently positions the positioned portion from above.

18. The image forming device according to claim 14, wherein the guide portion comprises guide protrusions that are plurally arranged along the installation of the replacement unit.

19. A replacement unit comprising:

a bottom member;

a guide groove provided in the bottom member and extending in an installation direction along which the replacement unit is installed into a device body, the guide groove provided for receiving a plurality of protrusions disposed in a row on a support member of the device body;

a positioned portion that protrudes from an installation direction distal end of the replacement unit, the positioned portion for positioning the replacement unit with respect to a positioning portion of the device body; and an attitude adjustment portion that is provided on the bottom member between a center of the replacement unit and the installation direction distal end, the attitude adjustment portion touching the support member during insertion to enable the positioned portion to engage with the positioning portion.

20. The replacement unit according to claim 19, wherein the positioned portion comprises a protrusion, and the attitude adjustment portion comprises a protrusion.

* * * * *